US008259039B2

(12) United States Patent
Abe

(10) Patent No.: US 8,259,039 B2
(45) Date of Patent: Sep. 4, 2012

(54) DISPLAY APPARATUS AND METHOD FOR DRIVING DISPLAY PANEL

(75) Inventor: Naoto Abe, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 157 days.

(21) Appl. No.: 12/952,468

(22) Filed: Nov. 23, 2010

(65) Prior Publication Data

US 2011/0122110 A1 May 26, 2011

(30) Foreign Application Priority Data

Nov. 26, 2009 (WO) ..... PCT/JP2009/069984

(51) Int. Cl.
*G09G 3/20* (2006.01)
*G09G 3/30* (2006.01)
*G09G 3/36* (2006.01)

(52) U.S. Cl. ..... 345/74.1; 345/76; 345/77; 345/102

(58) Field of Classification Search ..... 345/60–69, 345/76–82, 87, 98, 99, 100, 101, 102, 73, 345/74.1, 75.1, 75.2, 690, 204
See application file for complete search history.

(56) References Cited

U.S. PATENT DOCUMENTS 6,636,190 B2 * 10/2003 Hirakata et al. ..... 345/74.1
6,661,397 B2 * 12/2003 Mikami et al. ..... 345/76
7,119,786 B2 * 10/2006 Cui ..... 345/102
7,460,103 B2 * 12/2008 Konno et al. ..... 345/102
7,477,228 B2 * 1/2009 Wyatt ..... 345/102
7,522,132 B2 * 4/2009 Hamamoto et al. ..... 345/75.2
7,692,734 B2 * 4/2010 Fujita et al. ..... 349/61
8,013,821 B2 * 9/2011 Park ..... 345/87
8,085,238 B2 * 12/2011 Misonou et al. ..... 345/102
2005/0206634 A1 9/2005 Hamamoto

FOREIGN PATENT DOCUMENTS

JP 5-313626 A 11/1993
JP 2002-229511 A 8/2002
JP 2004-309373 A 11/2004
JP 2005-301229 A 10/2005
JP 2007-101702 A 4/2007

* cited by examiner

*Primary Examiner* — Duc Dinh
(74) *Attorney, Agent, or Firm* — Canon USA Inc IP Division

(57) ABSTRACT

A difference between the black level potential $V_B$ and the white level potential $V_W$ in the effective bright environment is smaller than a difference between the black level potential $V_B$ and the white level potential $V_W$ in the effective dark environment, and the black emission luminance in the effective bright environment is lower than or equal to a diffuse reflection luminance in the effective bright environment and higher than a black emission luminance in the effective dark environment.

12 Claims, 7 Drawing Sheets

DISPLAY APPARATUS AND METHOD FOR DRIVING DISPLAY PANEL

BACKGROUND OF THE INVENTION

1. Field of the Invention

The present invention relates to a display panel and, in particular, to a method for driving a display panel including matrix wiring and a display apparatus including the display panel.

2. Description of the Related Art

Some display panels include a plurality of display elements arranged in a matrix and connected to a matrix wiring including a plurality of row wirings and column wirings. In display apparatuses using such a display panel, a scanning signal is sequentially input to row wirings. At the same time, modulation signals corresponding to an image to be displayed are synchronously input to column wirings. By sequentially driving a plurality of display elements on a row-by-row basis in this manner, the image is displayed. Accordingly, the voltage applied to the display element and/or the electrical current flowing in the display element is controlled by the scanning signal and the modulation signal.

Japanese Patent Laid-Open No. 2005-301229 describes a technique to increase the dark-room contrast by changing the voltage level of a scanning selection signal and decreasing the luminance of the black level in response to an external instruction.

Japanese Patent Laid-Open No. 5-313626 describes a display apparatus including an illuminance measuring unit, a diffuse reflection luminance computing unit that computes the diffuse reflection luminance of a display surface using a measurement value output from the illuminance measuring unit, an emission luminance computing unit that computes the emission luminance on the basis of a signal output from the diffusion reflection luminance computing unit, and a light control unit that controls the emission luminance of the display surface on the basis of a signal output from the emission luminance computing unit.

Japanese Patent Laid-Open No. 2002-229511 describes a technique to control the power for driving an organic EL element of an organic EL panel in accordance with the illuminance of light coming from the outside.

In recent years, power consumption of a display apparatus is required to be reduced from the standpoint of environmental protection and cost reduction. In contrast, users require high-quality display apparatuses. It is difficult for existing technology to satisfy these two requirements at the same time. Accordingly, the present invention provides a method for driving a display panel and a display apparatus including the display panel to reduce power consumption without degrading the display quality that the user experiences.

SUMMARY OF INVENTION

To solve the above-described problem, the present invention provides a method for driving a display panel including a plurality of row wirings, a plurality of column wirings that intersect the plurality of row wirings, and a plurality of display elements each connected to one of the row wirings and one of the column wirings. A display operation is performed on a display surface of the display panel by sequentially applying a selection potential to each of the row wirings and applying, to each of the column wirings, a potential in the range from a first potential to a second potential in synchronization with the application of the selection potential to the row wiring. The display operation is performed within a range of an emission luminance of the display element which is connected to one of the row wirings having the applied selection potential. The range of the emission luminance is higher than or equal to an emission luminance obtained when the first potential is applied to one of the column wirings connected to the display element and lower than or equal to an emission luminance obtained when the second potential is applied to the column wiring connected to the display element. The method includes the step of making a change between (i) a first environment in which a diffuse reflection luminance occurring on the display surface when ambient light is incident on the display surface is equal to the emission luminance of the display element connected to the row wiring having the applied selection potential and the column wiring having the applied first potential and (ii) a second environment in which the diffuse reflection luminance is higher than the diffuse reflection luminance in the first environment, where the change is such that (a) a difference between the first potential and the second potential in the second environment is smaller than a difference between the first potential and the second potential in the first environment, and (b) the emission luminance of the display element connected to the row wiring having the applied selection potential and the column wiring having the applied first potential in the second environment is lower than or equal to the diffuse reflection luminance in the second environment and higher than the emission luminance of the display element connected to the row wiring having the applied selection potential and the column wiring having the applied first potential in the first environment.

Further features of the present invention will become apparent from the following description of exemplary embodiments with reference to the attached drawings.

DESCRIPTION OF EMBODIMENTS

Figure 1A:
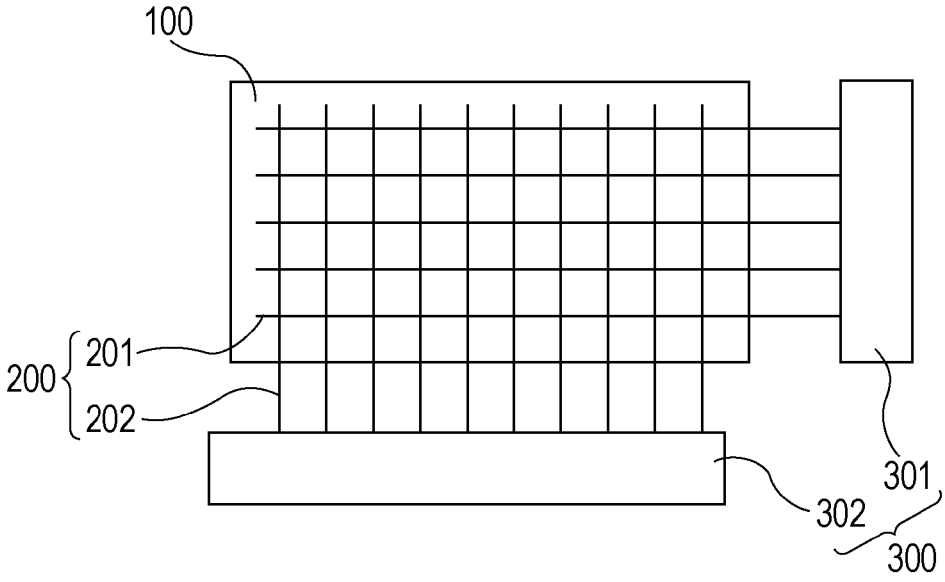
FIGS. 1A and 1B illustrate examples of a display apparatus and a display panel.
Figure 1B:
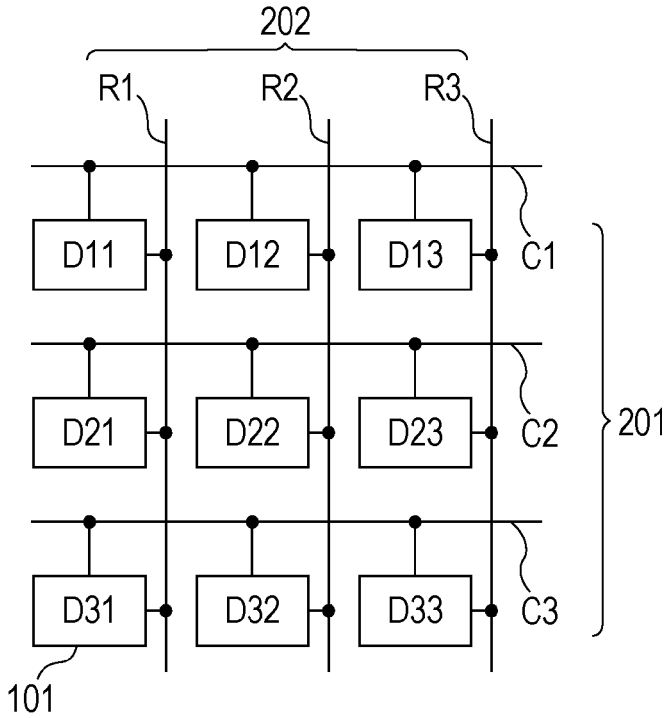

FIG. 1A is a schematic illustration of an exemplary configuration of a display apparatus. The display apparatus includes at least a display panel 100 and a drive circuit 300 for driving the display panel 100. The display panel 100 includes a matrix wiring 200. The matrix wiring 200 includes a plurality of row wirings 201 and a plurality of column wirings 202. The row wirings 201 intersect with the column wirings 202. At intersections, the row wirings 201 are electrically insulated from the column wirings 202. The drive circuit 300 includes a scanning circuit 301 and a modulation circuit 302. The scanning circuit 301 is connected to the row wirings 201, and the modulation circuit 302 is connected to the column wirings 202. In FIGS. 1A and 1B, the row wirings 201 extend in the horizontal direction, and the column wirings 202 extend in the vertical direction. However, the row wirings 201 and the column wirings 202 are not defined in accordance with the orientation of the display panel 100. The row wirings 201 are only required to be connected to the scanning circuit 301, and the column wirings 202 are only required to be connected to the modulation circuit 302.

FIG. 1B is a partial enlarged view of the display panel 100. The display panel 100 includes a plurality of display elements 101 arranged in a matrix. Each of the display elements 101 is connected to one of the row wirings 201 and one of the column wirings 202. The plurality of display elements 101 form a display surface of the display panel 100. In FIG. 1B, nine display elements 101 (D11 to D33) are shown. The nine display elements 101 are disposed at intersections of three row wirings 201 (C1, C2, and C3) and three column wirings 202 (R1, R2, and R3). For example, the display element D11 is connected to the row wiring C1 and the column wirings R1. The display element D12 is connected to the row wiring C1 and the column wiring R2. The display element D21 is connected to the row wiring C2 and the column wiring R1. The display element D33 is connected to the row wiring C3 and the column wiring R3.

Figure 2A:
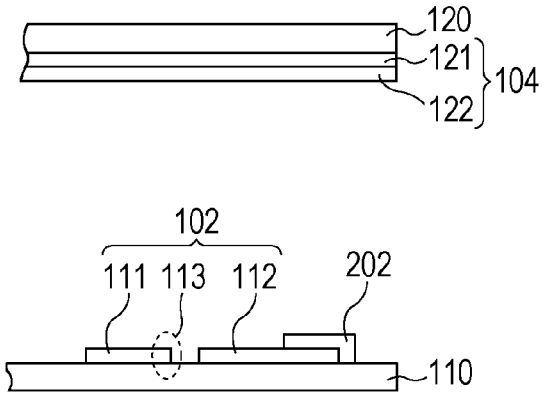
FIGS. 2A to 2D illustrate an example of a display element.

For example, a cathodoluminescence (CL) element can be used as the display element 101. FIG. 2A is a cross-sectional view of a CL element. The CL element includes an electron emitting device 102 connected to the row wiring 201 and the column wirings 202 and a display member 104 that faces the electron emitting device 102 with vacuum therebetween. The electron emitting device 102 is disposed on an insulating substrate 110. The display member 104 is disposed on a transparent substrate 120. The matrix wiring 200 is disposed on the insulating substrate 110.

An electron emitting device of a field emission type including a cathode 111 (a low-potential electrode) and a gate 112 (a high-potential electrode) can be used as the electron emitting device 102. Electron emission devices of a field emission type fall into the following types: an SCE (surface conduction electron) element, a Spindt element, a CNT element, an MIM element, an MIS element, and BSD element. However, the present invention is not limited to any element type. In the example shown in FIG. 2A, the cathode 111 includes an electron emitter 113 in a portion indicated by a dotted line. The electron emitter 113 of the cathode 111 faces the gate 112 with a spacing therebetween. Note that each of the cathode 111 and the gate 112 may be formed from a plurality of members.

The display member 104 includes at least a light emitting member 121. Typically, the display member 104 further includes a metal film 122. A phosphor can be used as the light emitting member 121. Typically, the light emitting member 121 serves as a display surface of the display panel 100. The metal film 122 reflects light emitted from the light emitting member 121 toward a user. The metal film 122 can be used as an anode electrode. When the metal film 122 is maintained at an anode potential level of several kV to several tens of kV, energy that is sufficient to cause the phosphor to emit light is supplied to emitted electrons. Note that the metal film 122 may be removed, and a transparent conductive film that serves as an anode electrode may be disposed between the light emitting member 121 and the transparent substrate 120.

Figure 2B:
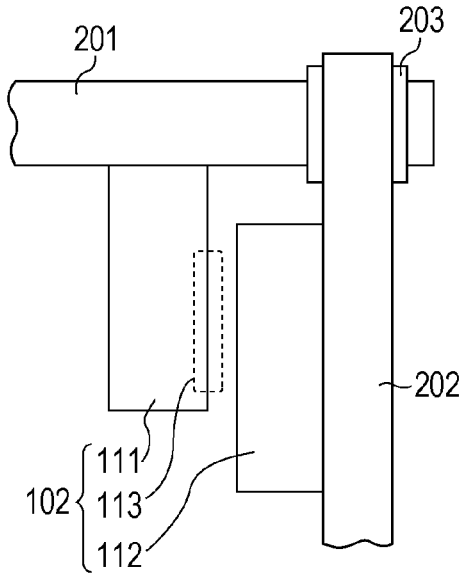

FIG. 2B is a plan view of the electron emitting device 102. The electron emitting device 102 including the cathode 111 connected to the row wirings 201 and the gate 112 connected to the column wirings 202, as shown in FIG. 2B, is described below. In FIG. 2B, the row wiring 201 is electrically insulated from the column wiring 202 by an insulating layer 203 disposed therebetween. When a potential is applied to the row wiring 201 and a potential is applied to the column wiring 202, a voltage (hereinafter referred to as a "drive voltage $V_D$") is generated in accordance with the difference in potential between the row wiring 201 and the column wiring 202. The drive voltage $V_D$ is applied to the electron emitting device 102. The electron emitting device 102 then emits a number of electrons in accordance with the drive voltage $V_D$. The emitted electrons are bombarded on the display member 104. Thus, the light emitting member 121 emits light having an intensity proportional to a number of emitted electrons (hereinafter referred to as an "emission current Ie").

Figure 2C:
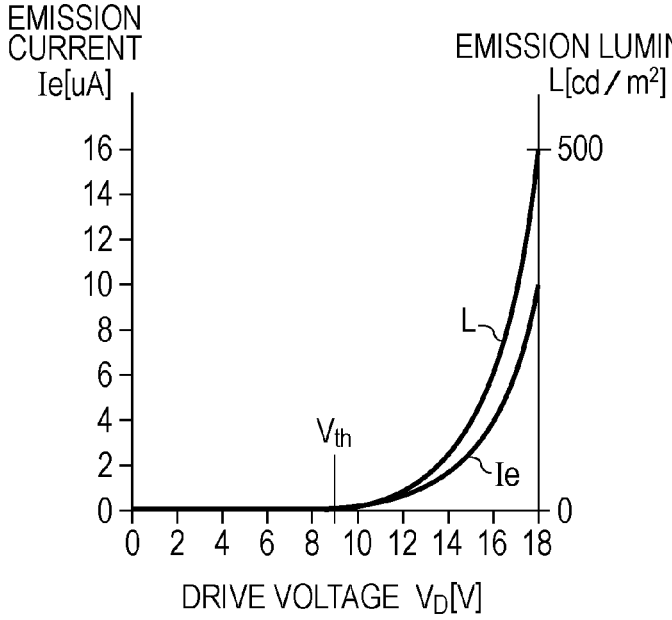

FIG. 2C is an example of a drive voltage $V_D$-emission current Ie characteristic and a drive voltage $V_D$-illuminance L characteristic of the electron emitting device 102 of a field emission type. In this example, an electron emitting device that generates a nearly zero emission current when the drive voltage is lower than or equal to 9 [V] is used. Accordingly, a threshold voltage $V_{th}$ is defined as 9 [V]. However, even in the vicinity of the threshold voltage $V_{th}$, the emission current is not completely zero. Therefore, for example, when the drive voltage is 8 [V], an emission luminance of about 0.0005 [cd/m$^2$] is observed. When the drive voltage is 9 [V], an emission luminance of about 0.01 [cd/m$^2$] is observed. When the drive voltage is 10 [V], an emission luminance of about 0.1 [cd/m$^2$] is observed. When the drive voltage is 11 [V], an emission luminance of about 1 [cd/m$^2$] is observed. In addition, the emission current of the electron emitting device employed in this example is 10 [μA] when the drive voltage is 18 [V]. At that time, an emission luminance of about 500 [cd/m$^2$] is observed. If the voltage applied to the electron emitting device exceeds 18 [V], the emission current is significantly increased. Thus, the electron emitting device may be damaged. Accordingly, the maximum value of the drive voltage $V_D$ is set to 18 [V]. That is, the peak emission luminance is 500 [cd/m$^2$]. Furthermore, in the electron emitting device of this example, when a reverse voltage is applied to the electron emitting device 102, the emission current and emission luminance are substantially zero.

Figure 2D:
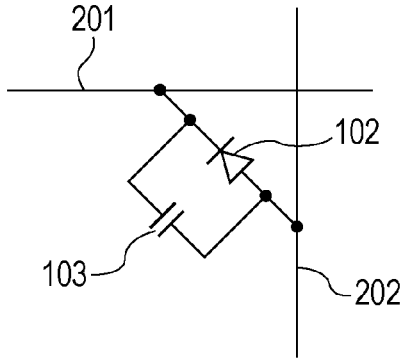

FIG. 2D illustrates an equivalent circuit of one of the display elements 101 connected to one of the row wirings 201 and one of the column wirings 202. In FIG. 2D, an electron emitting device 102 corresponds to the electron emitting device 102 shown in FIG. 2B. As shown in FIG. 2D, each of the display elements 101 of the display panel 100 has capacitance 103. The capacitance 103 includes the capacitance necessarily generated at an intersection of the row wiring 201 and the column wiring 202. In addition, the capacitance 103 includes capacitance intentionally provided to the display element 101 (typically the electron emitting device 102 in the case of a CL device) and/or capacitance generated unintentionally. Accordingly, the capacitance 103 has a total capacitance of $C_D$ [F]. The capacitance 103 is described in more detail below.

Figure 3A:
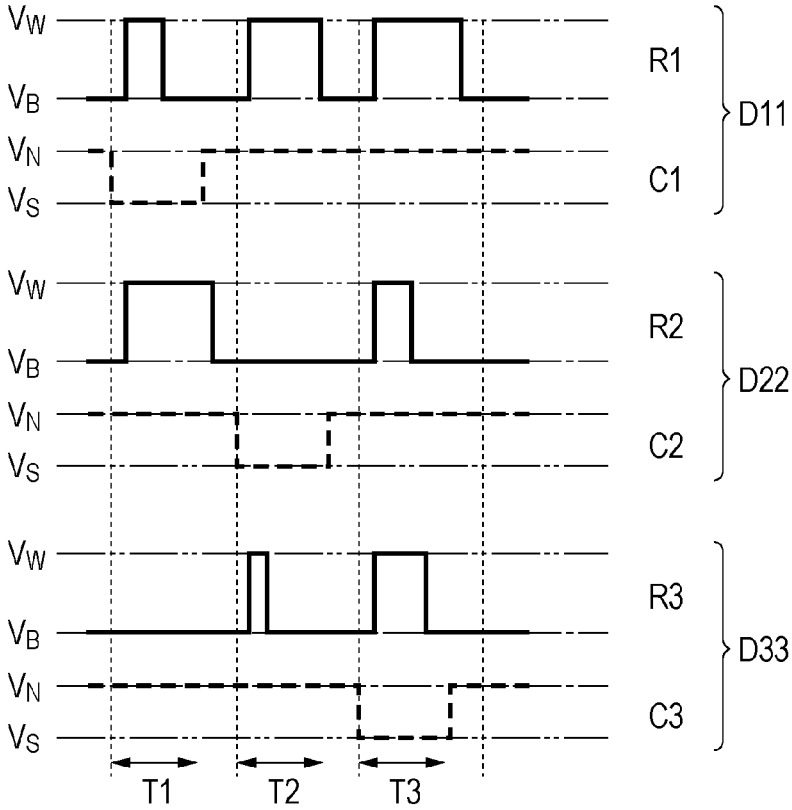
FIGS. 3A to 3D illustrate an example of a drive signal.

FIG. 3A illustrates an example of a waveform of a drive signal that is output from the drive circuit 300 to the display panel 100 and that causes the display panel 100 to perform a display operation. In this example, the waveforms of drive signals applied to three display elements D11, D22, and D33 are shown. The drive signal includes a scanning signal output from the scanning circuit 301 and a modulation signal output from the modulation circuit 302.

A scanning signal having one of a selection potential $V_S$ and a non-selection potential $V_N$ is input from the scanning circuit 301 to each of the row wirings 201. More specifically, the selection potential $V_S$ is applied to the row wiring 201 (C1) during a period T1, the selection potential $V_S$ is applied to the row wiring 201 (C2) during a period T2, and the selection potential $V_S$ is applied to the row wiring 201 (C3) during a period T3. The periods (T1, T2, and T3) during which the selection potential $V_S$ is applied to the row wirings 201 (C1, C2, and C3) are referred to as "selection periods". In contrast, the non-selection potential $V_N$ is applied to the row wirings 201 (C1, C2, and C3) during non-selection periods which are periods other than the selection periods. In this way, by alternately applying the potentials $V_S$ and $V_N$ in a temporal sequence and sequentially applying the selection potential $V_S$ to all of the row wirings 201, the row wirings 201 are scanned. The scanning method may be a progressive method or an interlace method. A period during which the selection potential $V_S$ is applied to all of the row wirings 201 is referred to as a "scanning period". In a progressive method, one display surface can be formed through one vertical scanning operation. In contrast, in an interlace method, one display surface can be formed through two vertical scanning operations. The number of times for rewriting a screen per second is referred to as a "refresh rate Fv (Hz)".

In contrast, a modulation signal having a modulation potential $V_M$ in the range from a black level potential $V_B$ to a white level potential $V_W$ is applied from the modulation circuit 302 to each of the column wirings 202. That is, the total amplitude (a wave height) $V_{MP-P}$ of the modulation signal is expressed as: $|V_W-V_B|$. The modulation signal can have a potential level of one of at least $V_B$ and $V_W$. The black level potential $V_B$ corresponds to a first potential of the present invention, and the white level potential $V_W$ corresponds to a second potential of the present invention. As described in more detail below, according to the present invention, the black level potential $V_B$ and the white level potential $V_W$ can be changed.

Figure 3B:
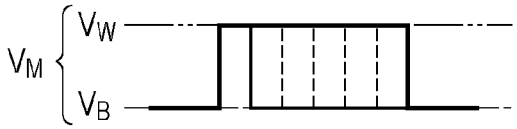
Figure 3C:
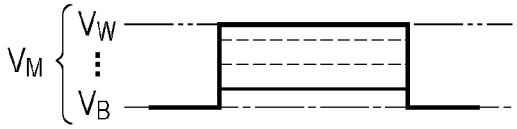
Figure 3D:
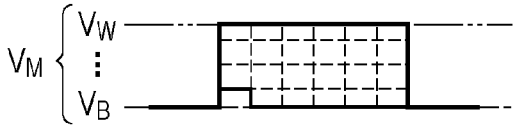

Examples of the waveforms of the modulation signal are shown in FIGS. 3B to 3D. FIG. 3B illustrates the case in which the modulation potential $V_M$ has two levels and pulse width modulation (PWM) is performed. By the PWM, gray scale display is performed by controlling a ratio of a period during which the black level potential $V_B$ is output to a period during which the white level potential $V_W$ is output (a duty ratio). Note that FIG. 3A illustrates an example of pulse width modulation. FIG. 3C illustrates the case in which the modulation potential $V_M$ has at least three levels including $V_B$ and $V_W$ and a level in the range between $V_B$ and $V_W$ and pulse amplitude modulation (PAM) is performed. By the PAM, gray scale display is performed by controlling the modulation potential $V_M$. FIG. 3D illustrates the case in which gray scale display is performed by using a combination of pulse width modulation and pulse amplitude modulation. This case is described in detail in Japanese Patent Laid-Open No. 2003-173159. Note that when gray scale display is performed by using a combination of pulse width modulation and pulse amplitude modulation, the potential for displaying the lowest gray scale is $V_B$. Of the modulation potential $V_M$ used for displaying a gray scale from the lowest gray scale to the highest gray scale, the highest potential is $V_W$. In typical drive methods, the highest gray scale is represented using $V_W$.

In this example, the cathode 111 of the electron emitting device 102 is connected to the row wirings 201, and the gate 112 is connected to the column wirings 202. Accordingly, $V_S$, $V_N$, $V_B$, and $V_W$ satisfy the following relationships: $V_S<V_B<V_W$, and $V_S<V_N$. However, when the cathode 111 is connected to the column wirings 202 and if the gate 112 is connected to the row wirings 201, the following relationships: $V_B<V_W<V_S$, and $V_N<V_S$ are satisfied. Note that the potentials $V_S$, $V_N$, $V_B$, and $V_W$ are defined using a reference potential of 0 [V] (the ground potential), and each of the potentials $V_S$, $V_N$, $V_B$, and $V_W$ has one of a positive value, 0 [V], and a negative value with respect to the reference potential.

The difference between $V_S$ and $V_W$ is set to be larger than or equal to the threshold value $V_{th}$. The electron emitting device 102 connected to the row wiring 201 to which the modulation potential $V_M$ is applied and the column wiring 202 to which the modulation potential $V_M$ is applied emits a number of electrons in accordance with the drive voltage $V_D$ determined by the difference between the selection potential $V_S$ and the modulation potential $V_M$. Thus, the light emitting member 121 of the display member 104 disposed so as to face the electron emitting device 102 emits light. In the examples shown in FIGS. 1A and 3A, the display element D11 connected to C1 and R1, the display element D12 connected to C1 and R2, and the display element D13 connected to C1 and R3 perform a display operation during the selection period T1. The display element D21 connected to C2 and R1, the display element D22 connected to C2 and R2, and the display element D23 connected to C2 and R3 perform a display operation during the selection period T2. The display element D31 connected to C3 and R1, the display element D32 connected to C3 and R2, and the display element D33 connected to C3 and R3 perform a display operation during the selection period T3.

In the PWM and the combination of PWM and PAM, the pulse width of the modulation signal, that is, a period during which a potential other than the black level potential $V_B$ ($V_B<V_M\leqq V_W$) is applied, is defined as a period between the periods during which the black level potential $V_B$ is applied. Accordingly, even when the modulation potential that differs from the black level potential $V_B$ is applied, the black level potential $V_B$ is applied to the column wiring 202 during each selection period. In the PAM, the pulse width of the modulation signal can be determined by start of a selection period and end of the selection period. However, it is desirable that the black level potential $V_B$ be applied to the column wiring 202 during each selection period. In addition, in any of the PWM, the PAM, and a combination of PWM and PAM, it is desirable that application of a potential other than the black level potential in one selection period be performed within the selection period. FIG. 3A illustrates a configuration in which the black level potential $V_B$ is applied at least when the selection period starts and ends.

The emission luminance of the display element 101 obtained when the selection potential $V_S$ is applied to the row wiring 201 and the white level potential $V_W$ is applied to the column wiring 202 is referred to a "white emission luminance". The white emission luminance is lower than or equal to the peak emission luminance of the display elements 101. The white emission luminance represents the highest value of the illuminance of the display element 101 when the selection potential $V_S$ is applied. That is, the modulation potential $V_M$ that maximizes the emission luminance of the display element 101 is the white level potential $V_W$. Note that unlike the name "white emission luminance" implies, the display color of the display element or the display member 104 is not limited to white. Even when the color is red, green, or blue, the term "white emission luminance" is used for the sake of convenience.

In addition, the emission luminance obtained when the selection potential $V_S$ is applied to the row wiring 201 and the black level potential $V_B$ is applied to the column wiring 202 is referred to as "black emission luminance". The black emission luminance is higher than or equal to 0 [cd/m$^2$]. The black emission luminance represents the lowest value of the illuminance of the display element 101 when the selection potential $V_S$ is applied. That is, the modulation potential $V_M$ that minimizes the emission luminance of the display element 101 is the selection potential $V_S$.

As described above, the display panel 100 performs a display operation with an emission luminance in the range from the black emission luminance to the white emission luminance in accordance with the modulation potential $V_M$ in the range from the black level potential $V_B$ to the white level potential $V_W$. The range of the emission luminance is determined by the black level potential $V_B$ and the white level potential $V_W$.

As used herein, a ratio of the white emission luminance to the black emission luminance is defined as an "emission contrast ratio". The emission contrast ratio varies in accordance with the performance of the display panel 100. The emission contrast ratio is an important factor that is related to the display quality. In general, as the emission contrast ratio increases, the display quality increases.

For example, let $V_S$=−8 [V], $V_N$=0 [V], $V_B$=0 [V], and $V_W$=−8 [V]. Then, the drive voltage $V_D$ of 8 [V] is applied to the electron emitting device 102 connected to the row wiring 201 having an applied potential of $V_S$=−8 [V] and the column wiring 202 having an applied potential $V_B$=0 [V] during a selection period. Accordingly, the black emission luminance is about 0.0005 [cd/m$^2$]. In addition, the drive voltage $V_D$ of 18 [V] is applied to the electron emitting device 102 connected to the row wiring 201 having an applied potential $V_S$=−8 [V] and the column wiring 202 having an applied potential $V_W$=+10 [V]. Accordingly, as shown in FIG. 2D, the level of the emission current output from the electron emitting device 102 is 10 [μA]. Thus, the white emission luminance is about 500 [cd/m$^2$]. Therefore, the emission contrast ratio is 1,000,000:1. That is, a significantly excellent display quality can be obtained. Note that the emission luminance is determined by measuring the integration value of the emission luminance per second when the display panel 100 having 1,080 row wirings 201 is scanned using a progressive method in a dark room.

In the above-described example, $V_D$ of 10 [V] is applied to the electron emitting device 102 connected to the row wiring 201 having an applied potential $V_N$=0 [V] and the column wiring 202 having an applied potential $V_W$=+10 [V] during a non-selection period. When $V_B$=0 [V] is applied, $V_D$=0 [V]. Accordingly, the emission luminance of the display member during a non-selection period is in the range of about 0 to about 0.1 [cd/m$^2$]. In order to increase the display quality, it is desirable that the emission luminance during the non-selection period be low. Accordingly, if $V_N$ is set to +5 [V], $V_D$=5 [V] when $V_W$ of +10 [V] is applied. If $V_B$ of 0 [V] is applied, VD=−5 [V]. In this way, by setting the non-selection potential $V_N$ to a value in the range from $V_W$ to $V_B$, the emission luminance can be reduced to a sufficiently low value during the non-selection period. For display elements having an emission luminance of nearly zero when a reverse voltage is applied as the drive voltage $V_D$, it is more desirable that $V_N$ be equal to $V_W$. In contrast, for display elements having an emission luminance that is the same as that obtained when a forward voltage is applied when a reverse voltage is applied as the drive voltage $V_D$, it is more desirable that $V_N$ be set to a value in the middle of $V_W$ and $V_B$ ($(V_B+V_W)/2$).

Power consumption of the display apparatus when the display panel 100 is driven is described next. As noted above, in the case of a pulse width modulation, the modulation signal output from the modulation circuit 302 to the column wiring 202 is changed from the black level potential $V_B$ to the white level potential $V_W$ and is changed from the white level potential $V_W$ to the black level potential $V_B$ for each of the selection periods. Accordingly, the capacitance 103 shown in FIG. 2C is charged when the modulation signal is changed from the black level potential $V_B$ to the white level potential $V_W$. In contrast, the capacitance 103 is discharged when the modulation signal is changed from the white level potential $V_W$ to the black level potential $V_B$. The power of the display apparatus is also consumed in the form of "charging/discharging power" which is caused by the above-described charging and discharging operations. Most of the charging/discharging power is consumed by a resistance component of the modulation circuit 302 and the column wirings 202 and is transformed into heat. Accordingly, this power is waste power that is not used for light emission of the display elements 101.

When the number of the column wirings 202 is X and the number of the row wirings 201 is Y, the capacitance of one of the column wirings 202 is proportional to the number of the row wirings 201 that intersect with the column wiring 202. Accordingly, the capacitance is $C_D$×Y. When the display panel 100 is operated at a refresh rate of $F_V$ [Hz], the charging/discharging power $P_M$ (the power consumed per second) from the viewpoint of the modulation circuit 302 can be given as follows:

$$P_M=\tfrac{1}{2}\times(C_D\times Y)\times(V_W-V_B)^2\times(N\times Y)\times X\times F_V \quad (1)$$

where N represents the number of changes in the potential of the modulation signal during a selection period, and (N×Y) represents the number of changes in the potential of the modulation signal during a scanning period. As shown in FIG. 3A, in the case of pulse width modulation, a change from $V_E$, to $V_W$ and a change from $V_W$ to $V_B$ necessarily occur for each of the selection periods. Accordingly, N=2. Thus, in the case of pulse width modulation, the charging/discharging power is produced regardless of the emission luminance when a display operation with an emission luminance higher than the black emission luminance is performed.

In the case of pulse amplitude modulation or a combination of pulse width modulation and pulse amplitude modulation, the highest charging/discharging power can be computed as in the pulse width modulation if it is assumed that the white level potential $V_W$ is applied to all of the column wirings 202 for each of the selection periods. Even in the case of pulse amplitude modulation, if the black level potential $V_B$ is applied for each of the selection periods, two changes occur. Thus, N=2. In the case of pulse amplitude modulation, two changes are not needed for each of the selection periods. However, if an image is displayed, a number of changes occur in accordance with the image. For example, when a stripe pattern in which a white emission luminance and a black emission luminance is alternately repeated in the row wirings 201 is displayed, at least a change from $V_B$ to $V_W$ and a change from $V_W$ to $V_B$ occur for every two selection periods. Thus, N=1.

Similarly, the capacitance 103 shown in FIG. 2C is charged and discharged when the scanning signal is changed from $V_N$ to $V_S$ and from $V_S$ to $V_N$. From the viewpoint of the scanning circuit 301, the capacitance of one row wiring is proportional to the number of the column wirings 202 that intersect with the row wiring 201. Accordingly, the capacitance is $C_D$×X. When the display panel 100 is operated at a refresh rate of $F_V$ [Hz], the charging/discharging power $P_S$ (the power consumed per second) from the viewpoint of the scanning circuit 301 can be given as follows:

$$P_S=\tfrac{1}{2}\times(C_D\times X)\times(V_N-V_S)^2\times(2\times 1)\times Y\times F_V \quad (2)$$

where (2×1) represents the number of changes in the potential of the scanning signal during a selection period.

From a comparison of equations (1) and equation (2)

$$\text{when } N=2, \text{ if } Y>\{(V_N-V_S)/(V_W-V_B)\}^2 \quad (3)$$

is satisfied, $P_M>P_S$. That is, the number (Y) of the row wirings is greater than the square of a value $(V_N-V_S)/(V_W-V_B)$ obtained by dividing a difference $(V_N-V_S)$ between the selection potential ($V_S$) and the non-selection potential ($V_N$) by a difference ($V_W$–$V_B$) between the first potential ($V_B$) and the second potential ($V_W$) in the first and second modes. Therefore, the charging/discharging power $P_M$ from the viewpoint of the modulation circuit 302 is higher than the charging/discharging power $P_S$ from the viewpoint of the scanning circuit 301. In addition, a typical circuit configuration of the modulation circuit 302 is more complicated than that of the scanning circuit 301. Accordingly, in general, the heat dissipated from the modulation circuit 302 is higher than that from the scanning circuit 301.

Typical HDTV display panels have X=1920×3 and Y=1080. When an electron emitting device of a field emission type is used as the display element 101, $C_D$=0.4 [pF], for example. Let $V_W$=+9 [V], $V_B$=0 [V], $V_N$=0 [V], $V_S$=−9 [V], N=2, and $F_V$=60 [Hz]. Then, the charging/discharging power $P_M$ from the viewpoint of the modulation circuit 302 is 13 [W]. In contrast, the charging/discharging power $P_S$ from the viewpoint of the scanning circuit 301 is 12 [mW], which is about 1/1000 of $P_M$. In addition, when the refresh rate $F_V$ is set to 120 [Hz] in order to prevent the occurrence of flicker, each of $P_M$ and $P_S$ is doubled and, therefore, the difference between $P_M$ and $P_S$ increases.

For the above-described reason, in order to reduce the power consumption of the display apparatus, reducing the charging/discharging power $P_M$ from the viewpoint of the modulation circuit 302 is effective. In particular, as can be seen from equation (1), the charging/discharging power $P_M$ is proportional to $(V_W-V_B)^2$. Accordingly, in order to significantly reduce the power consumption of the modulation circuit 302, at least one of the white level potential $V_W$ and the black level potential $V_B$ can be changed so that the difference between the black level potential $V_B$ and the white level potential $V_W$ of the modulation potential $|V_W-V_B|$ is decreased. In CL elements, $V_W>V_B$. Accordingly, one of the following methods can be employed: a method for decreasing $V_W$ while maintaining $V_B$ unchanged, a method for increasing $V_B$ while maintaining $V_W$ unchanged, and a method for increasing $V_B$ and decreasing $V_W$. In addition, one of the following methods can be employed: a method for decreasing $V_W$ and $V_B$ so that $V_W$ is further decreased as compared with $V_B$ and a method for increasing $V_W$ and $V_B$ so that $V_B$ is further increased as compared with $V_W$.

However, just decreasing the difference between $V_B$ and $V_W$ decreases the emission contrast ratio and, therefore, degradation of the display quality may be noticeably observed. Accordingly, the present inventor found what conditions are necessary for preventing the degradation of the display quality that is experienced by the user when reducing the difference between $V_B$ and $V_W$.

When light is incident on the display surface of the display panel 100 from the outside of the display panel 100, the user experiences that the brightness of the display surface is increased due to diffuse reflection from the display surface of the display panel 100. As used herein, the light incident on the display surface of the display panel 100 from the outside of the display panel 100 is referred to as "ambient light". The emission luminance occurring on the display surface due to the ambient light is referred to as a "diffuse reflection luminance". The diffuse reflection luminance is proportional to the diffuse reflectivity of the display surface and the luminance of the ambient light. An attempt to decrease the diffuse reflectivity of the display surface by processing the display surface has been made. However, it is impossible to obtain a diffuse reflectivity of 0%. More specifically, the diffuse reflection luminance is an emission luminance of the display surface measured when the emission luminance of the display element 101 is set to 0 [cd/m$^2$]. In contrast, the above-described emission luminance is the emission luminance of the display element 101 when the diffuse reflection luminance is set to 0 [cd/m$^2$] (i.e., when the illuminance of the ambient light is set to 0 [lx]).

The brightness of the display elements 101 observed by the user is determined by the sum of the emission luminance and diffuse reflection luminance. This brightness is referred to as "display luminance". As used herein, the sum of the black emission luminance and the diffuse reflection luminance is referred to as "black display luminance", and the sum of the white emission luminance and the diffuse reflection luminance is referred to as "white display luminance". In addition, the ratio of the white display luminance to the black display luminance is referred to as a "display contrast ratio". In general, the display contrast ratio is called "dark room contrast ratio" when the illuminance of the ambient light is low, and the display contrast ratio is called "bright room contrast ratio" when the illuminance of the ambient light is high.

When the white emission luminance and the black emission luminance remain unchanged and if the illuminance of the ambient light increases, the display contrast ratio decreases, although the emission contrast ratio remains unchanged. At that time, the user senses as if a change in the white display luminance was small and a change in the black display luminance was large. This phenomenon is referred to as an "untrue black phenomenon".

The untrue black phenomenon is related to the ratio of the black emission luminance to the diffuse reflection luminance. When the diffuse reflection luminance is lower than the black emission luminance, the black emission luminance dominates the user's brightness perception. However, when the diffuse reflection luminance is higher than the black emission luminance, the diffuse reflection luminance dominates the user's brightness perception. This is because the user perceives the brightness on the basis of the ratio between the black emission luminance and the diffuse reflection luminance, not the difference between the black emission luminance and the diffuse reflection luminance. The higher one of the diffuse reflection luminance and the black emission luminance that the user perceives is referred to as an "effective black emission luminance". Similarly, the higher one of the diffuse reflection luminance and the white emission luminance that the user perceives is referred to as an "effective white emission luminance". In a normal use environment, the white emission luminance is higher than the diffuse reflection luminance. As used herein, the ratio of the effective white emission luminance to the effective black emission luminance is referred to as an "effective contrast ratio". An environment that changes in accordance with the illuminance of ambient light and in which the diffuse reflection luminance is higher than the black emission luminance is referred to as an "effective bright environment". In contrast, an environment in which the diffuse reflection luminance is lower than the black emission luminance is referred to as an "effective dark environment". An environment in which the diffuse reflection luminance is equal to the black emission luminance is referred to as a "reference environment". The diffuse reflection luminance in this environment is referred to as a "reference diffuse reflection luminance". In addition, the illuminance of the ambient light in this environment is referred to as a "reference illuminance". Note that when the black emission luminance is 0 [cd/m$^2$], the reference diffuse reflection luminance is 0 [cd/m$^2$] and the reference illuminance is 0 [lx]. The effective contrast ratio in the effective dark environment is referred to as an "effective dark room contrast ratio". The effective contrast ratio in the effective bright environment is referred to as an "effective bright room contrast ratio".

Figure 4A:
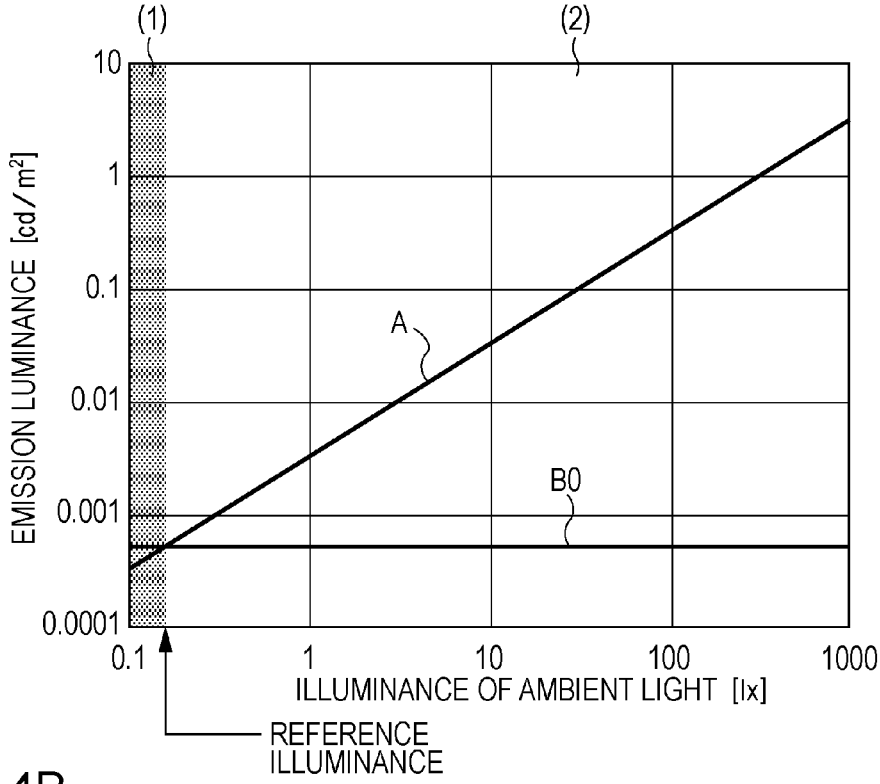
FIGS. 4A and 4B illustrate an example of a method for driving the display panel.

FIG. 4A illustrates a relationship between the black emission luminance and the diffuse reflection luminance of the above-described display panel having an emission contrast ratio of 1,000,000:1. The abscissa represents the illuminance of ambient light [lx] made incident on the display surface, and the ordinate represents the black emission luminance and the diffuse reflection luminance [cd/m$^2$]. In FIG. 4A, a line A represents the diffuse reflection luminance when the diffuse reflectivity of the display surface is 1%. The diffuse reflection luminance is defined as (the diffuse reflectivity×the illuminance of ambient light/π). A line B represents the black emission luminance. A line B0 represents the black emission luminance of the display panel itself, which represents a constant value 0.0005 [cd/m$^2$] regardless of the illuminance of ambient light.

At an intersecting point of the line A and the line B0, the diffuse reflection luminance is 0.0005 [cd/m$^2$], and the illuminance of ambient light is 0.16 [lx]. Accordingly, the reference illuminance is 0.0005 [cd/m$^2$], and the reference illuminance is 0.16 [lx]. In FIG. 4A, an area (1) represents an area in which the illuminance of ambient light is lower than the reference illuminance and represents an effective dark environment in which the diffuse reflection luminance is lower than the black emission luminance. Thus, the line A is located below the line B0. An area (2) represents an area in which the illuminance of ambient light is higher than the reference illuminance and represents an effective bright environment in which the diffuse reflection luminance is higher than the black emission luminance. Thus, the line A is located above the line B. As the illuminance of ambient light increases, the diffuse reflection luminance increases. When the illuminance of ambient light exceeds the reference illuminance, the effective dark environment is switched to the effective bright environment. Thus, as a factor that determines the display quality the user experiences, the effective dark contrast ratio is replaced by the effective bright contrast ratio.

Figure 4B:
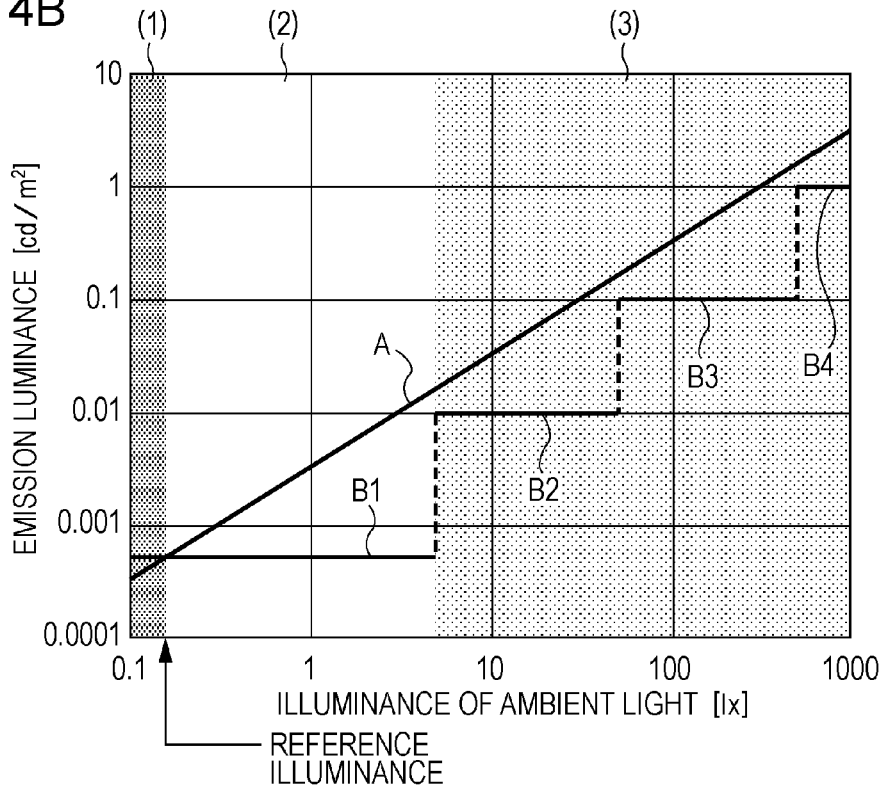

FIG. 4B illustrates an example in which the black emission luminance is varied in accordance with the illuminance of the ambient light. The abscissa, the ordinate, and the line A are the same as those in FIG. 4A. Lines B1 to B4 represent the black emission luminance. As the illuminance of the ambient light increases, the black emission luminance is set to a higher value. Note that part of the line B1 is the same as part of the line B0.

In FIG. 4B, an area (1) represents an area in which the illuminance of ambient light is lower than the reference illuminance and represents an effective dark environment in which the diffuse reflection luminance is lower than the black emission luminance. Thus, the line A is located below the line B1. Areas (2) and (3) represent areas in which the illuminance of ambient light is higher than the reference illuminance and represent effective bright environments in which the diffuse reflection luminance is higher than the black emission luminance. Thus, the line A is located above the lines B1 to B4.

As in FIG. 4A, in FIG. 4B, when the illuminance of ambient light exceeds the reference illuminance, the effective dark contrast ratio is replaced by the effective bright contrast ratio as a factor that determines the display quality the user experiences. In addition, in FIG. 4B, the areas (2) and (3) represent effective bright environments. Accordingly, a change in the effective contrast ratio is the same as that in FIG. 4A although the black emission luminance in the area (3) is higher than those in the areas (1) and (2). Therefore, the difference in display quality that the user experiences is small between when, as shown in FIG. 4A, the black emission luminance is set to a constant value in the effective dark environment and light environment and when, as shown in FIG. 4B, the black emission luminance in the effective bright environment is set to be higher than in the effective dark environment.

Accordingly, when the diffuse reflection luminance is higher than the reference diffuse reflection luminance and if the black illuminance is not higher than the diffuse reflection luminance, a decrease in the effective contrast ratio can be minimized. Therefore, if $|V_W-V_B|$ is decreased by increasing the black emission luminance to a value lower than or equal to the diffuse reflection luminance, the charging/discharging power $P_M$ can be reduced without a decrease in the display quality that the user experiences.

By changing at least one of the black level potential $V_B$ and the selection potential $V_S$ so that the difference between the black level potential $V_B$ and the selection potential $V_S$ ($|V_B-V_S|$) is increased, the black emission luminance can be increased. If $V_B>V_S$, one of the following methods can be employed: a method for decreasing $V_S$ while maintaining $V_B$ unchanged, a method for increasing $V_E$, while maintaining $V_S$ unchanged, and a method for decreasing $V_B$ and decreasing $V_S$. In addition, one of the following methods can be employed: a method for decreasing $V_B$ and $V_S$ so that $V_S$ is further decreased as compared with $V_B$ and a method for increasing $V_B$ and $V_S$ so that $V_B$ is further increased as compared with $V_S$.

As can be seen from the above description, when the illuminance of the ambient light is higher than the reference illuminance and if the diffuse reflection luminance is higher than the reference diffuse reflection luminance, $|V_W-V_B|$ is decreased and the black emission luminance is increased. At that time, the black emission luminance is set to a value lower than or equal to the diffuse reflection luminance. More specifically, the above-described method for decreasing $|V_W-V_B|$ can be appropriately combined with the above-described method for increasing $|V_B-V_S|$ and can be used so that the above-described condition is satisfied. By satisfying the above-described condition, the power consumption in the effective bright environment can be reduced without a decrease in the display quality that the user experiences. In addition, as the illuminance of the ambient light increases, the diffuse reflection luminance increases. Accordingly, the upper limit of the black emission luminance that can prevent a decrease in the display quality that the user experiences is increased. Therefore, as the illuminance of the ambient light increases, the charging/discharging power $P_M$ can be further decreased.

An example of the present embodiment is described below.

FIGS. 5A to 5D illustrate examples of the waveforms of the modulation signal and the scanning signal input to the row wiring C1 and the column wiring R1, respectively, in an effective dark environment, a reference environment, and an effective bright environment. Note that since the following description also applies to the row wirings C2 and C3 and the column wirings R2 and R3, descriptions thereof are not repeated.

Figure 5A:
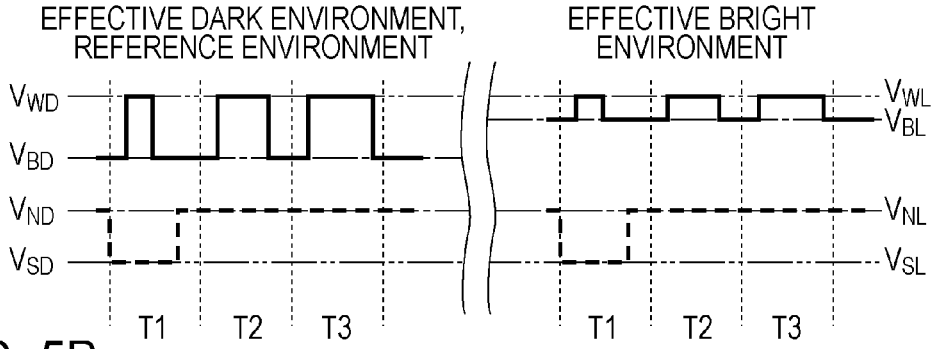
FIGS. 5A to 5D illustrate an example of a drive signal.

As shown in FIG. 5A, in the effective dark environment and the reference environment, the black level potential is $V_{BD}$, and the white level potential is $V_{WD}$. In addition, the selection potential is $V_{SD}$, and the non-selection potential is $V_{ND}$. In the effective bright environment, the black level potential is $V_{BL}$, and the white level potential is $V_{WL}$. In addition, the selection potential is $V_{SL}$, and the non-selection potential is $V_{NL}$. In this example, $V_{ND}=V_{NL}$, $V_{SD}=V_{SL}$, $V_{WD}=V_{WL}$, and $V_{BD}<V_{BL}$. Since $V_{WD}=V_{WL}$ and $V_{BD}<V_{BL}$, $V_{WD}-V_{BD}<V_{WL}-V_{BL}$. Accordingly, the charging/discharging power in the effective bright environment can be lower than the charging/discharging power in the effective dark environment and the reference environment. At that time, $V_{SD}=V_{SL}$ and $V_{BD}<V_{BL}$. Therefore, $V_{BD}-V_{SD}<V_{BL}$ $V_{SL}$. Thus, the black emission luminance in the effective bright environment is higher than that in the effective dark environment and the reference environment. Since the black emission luminance in the effective bright environment is lower than the diffuse reflection luminance, a decrease in the effective contrast ratio can be minimized. Furthermore, $V_{SD}=V_{SL}$ and $V_{WD}=V_{WL}$. Accordingly, $V_{WD}-V_{SD}=V_{WL}-V_{SL}$. The white emission luminance is constant. Thus, a decrease in the effective contrast ratio can be prevented.

Figure 5B:
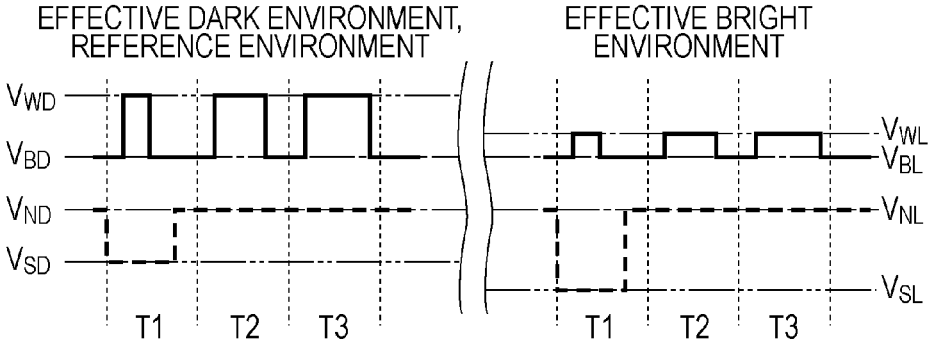

In FIG. 5B, $V_{ND}=V_{NL}$, $V_{SD}>V_{SL}$, $V_{WD}>V_{WL}$, $V_{BD}=V_{BL}$, and $V_{WD}-V_{SD}=V_{WL}-V_{SL}$.

Since $V_{WD}>V_{WL}$ and $V_{BD}=V_{BL}$, $V_{WD}-V_{BD}=V_{WL}-V_{BL}$. Accordingly, the charging/discharging power in the effective bright environment can be made lower than the charging/discharging power in the effective dark environment and the reference environment. In addition, since $V_{BD}>V_{BL}$ and $V_{SD}=V_{SL}$, $V_{BD}-V_{SD}<V_{BL}-V_{SL}$. Accordingly, the black emission luminance in the effective bright environment is higher than those in the effective dark environment and the reference environment. Since the black emission luminance is lower than the diffuse reflection luminance in the effective bright environment, a decrease in the effective contrast ratio can be minimized.

In this example, in order to establish the relationship: $V_{WD}-V_{SD}=V_{WL}-V_{SL}$, the white emission luminance is maintained unchanged. In order to set the white emission luminance in the effective bright environment to a value lower than that in the effective dark environment, the relationship: $V_{WD}-V_{SD}>V_{WL}-V_{SL}$ can be used. However, as described below, it is desirable that the relationship: $V_{WD}-V_{SD}\leqq V_{WL}-V_{SL}$ be used. According to the present invention, power consumption can be reduced with a minimized decrease in the display quality that the user experiences. However, there is still a trade off between the power consumption and the display quality. The white emission luminance can be set so that the balance between the power consumption and the display quality is optimized.

For example, in FIG. 4B, when the illuminance of the ambient light is 0.1 [lx], the diffuse reflection luminance is about 0.0003 [cd/m$^2$]. In addition, in FIGS. 5A and 5B, let $V_{SD}=-8$ [V], $V_{ND}=0$ [V], $V_{BD}=0$ [V], and $V_{WD}=+10$ [V]. Then, the black emission luminance is 0.0005 [cd/m$^2$], which indicates an effective dark environment.

In contrast, when the illuminance of the ambient light is 100 [lx], the diffuse reflection luminance is about 0.3 [cd/m$^2$]. In the example shown in FIG. 5A, let $V_{SL}=-8$ [V], $V_{NL}=0$ [V], $V_{BL}=+1$ [V], and $V_{WL}=+10$ [V]. In the example shown in FIG. 4B, let $V_{SL}=-10$ [V], $V_{NL}=0$ [V], $V_{BL}=0$ [V], and $V_{WL}=+8$ [V]. Then, the black emission luminance is about 0.1 [cd/m$^2$] in either one of the examples shown FIGS. 5A and 5B. However, since the diffuse reflection luminance is about 0.3 [cd/m$^2$] in either one of the examples shown FIGS. 5A and 5B, the effective bright environment appears. Therefore, even when the black emission luminance is increased, a decrease in the display quality that the user experiences can be prevented. In FIG. 5B, the white emission luminance when the illuminance of the ambient light is 0.1 [lx] is the same as that when the illuminance of the ambient light is 100 [lx]. Accordingly, as described above, a decrease in the display quality can be further prevented.

The charging/discharging power $P_M$ required when the capacitance CD=0.4 [pF] and the refresh rate is 60 [Hz] is 16.2 [W] if the illuminance of the ambient light is 0.1 [lx]. However, if the illuminance of the ambient light is 100 [lx], the charging/discharging power $P_M$ is 10.4 [W]. Thus, the charging/discharging power can be reduced by 6.8 [W]. In addition, if the refresh rate is set to 120 [Hz] in order to prevent the occurrence of flicker, the charging/discharging power $P_M$ is 32.4 [W] when the illuminance of the ambient light is 0.1 [lx]. In contrast, when the illuminance of the ambient light is 100 [lx], the charging/discharging power $P_M$ is 20.7 [W]. Thus, the charging/discharging power can be reduced by 11.7 [W]. In addition, in the example shown in FIG. 5B, the condition: $V_{WD}>V_{WL}>0$ is satisfied. Accordingly, the consumption power including the charging/discharging power of the modulation circuit 302 can be reduced. Note that an increase in the black emission luminance increases the power of a DC current consumed in the display element 101, that is, the power of a DC current due to an emission current Ie and the anode potential. However, an increase in the emission current Ie required for increasing the black emission luminance is significantly small. Thus, an increase in the power of the DC current is sufficiently small as compared with the charging/discharging power.

Figure 5C:
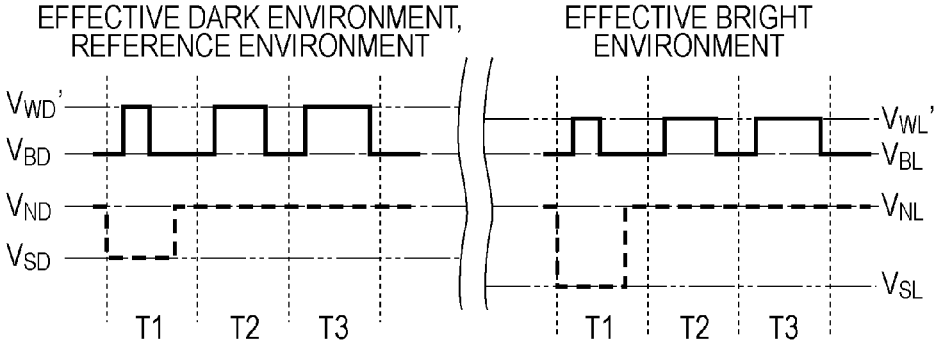

In FIG. 5C, in the effective dark environment, the black level potential is $V_{BD}$, the white level potential is $V_{WD}'$, the selection potential is $V_{SD}$, and the non-selection potential is $V_{ND}$. In the effective bright environment, the black level potential is $V_{BL}$, the white level potential is $V_{WL}'$, the selection potential is $V_{SL}$, and the non-selection potential is $V_{NL}$.

At that time, the following relationships are satisfied: $V_{ND}=V_{NL}$, $V_{SD}>V_{SL}$, $V_{WD}'>V_{WL}'$, $V_{BD}=V_{BL}$, and $V_{WD}'-V_{SD}<V_{WL}'-V_{SL}$. In this example, since $V_{WD}'-V_{SD}<V_{WL}'-V_{SL}$, the white emission luminance in the effective bright environment is higher than that in the effective dark environment. Thus, the effective bright room contrast ratio is improved as compared with the effective dark room contrast ratio. Accordingly, in the effective bright environment, as the illuminance of the ambient light increases, the emission luminance of the display apparatus can be increased. Thus, sufficient brightness can be provided to the user without a decrease in display quality. Thus, the display quality can be improved. In addition, the charging/discharging power in the effective bright environment is reduced as compared with that in the effective dark environment. Therefore, even when the white emission luminance is increased, an increase in power consumption of the display apparatus can be prevented.

Figure 5D:
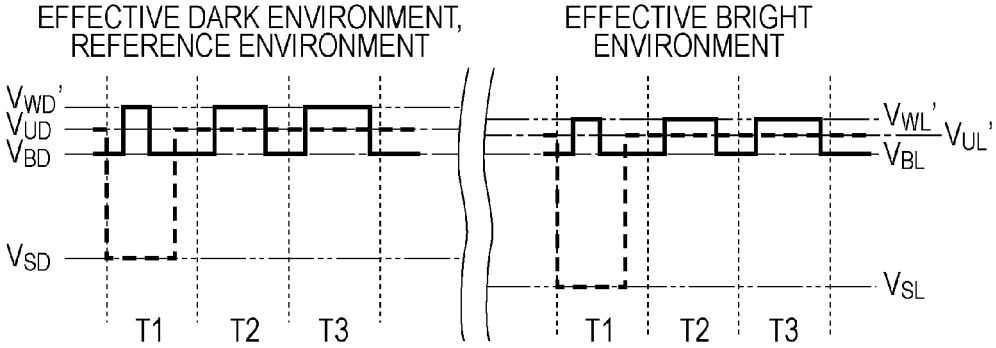

In FIG. 5D, in the effective dark environment, the black level potential is $V_{BD}$, the white level potential is $V_{WD}'$, the selection potential is $V_{SD}$, and the non-selection potential is $V_{UD}$. In the effective bright environment, the black level potential is $V_{BL}$, the white level potential is $V_{WL}'$, the selection potential is $V_{SL}$, and the non-selection potential is $V_{UL}'$. In this example, the relationships among $V_{SD}$, $V_{BD}$, $V_{WD}$, $V_{SL}$, $V_{BL}$, and $V_{WL}'$ are the same as those in FIG. 5C. In addition, $V_{BD}<V_{DD}<V_{WD}'$, and $V_{BL}<V_{UL}'<V_{WL}'$.

In this way, by setting the non-selection potential to a value in the range from the black level potential to the white level potential, the emission luminance of the display elements 101 during the non-selection period can be decreased. In this example, the conditions: $V_{BD}<V_{UD}<V_{WD}'$ and $V_{BL}<V_{UL}'<V_{WL}'$ are set for the effective dark environment and the effective bright environment. However, the conditions may be set for either one of the effective dark environment and the effective bright environment. When the conditions are set for either one of the effective dark environment and the effective bright environment, it is desirable that the relationship: $V_{BD}<V_{UD}<V_{WD}'$ be satisfied in the effective dark environment. Note that in FIG. 5D, the non-selection potential is set to a value in the range from the black level potential to the white level potential with respect to FIG. 5C. However, the same can apply to FIGS. 5A and 5B.

The above description has been made with reference to a configuration in which the low potential electrode of the display element 101 is connected to the row wiring 201, the high potential electrode of the display element 101 is connected to the column wiring 202, the selection potential $V_S$ is negative potential, and the modulation potential $V_M$ is positive potential. It should be noted that both of the selection potential $V_S$ and the modulation potential $V_M$ may be positive potentials or negative potentials. However, by setting the selection potential $V_S$ to negative potential and setting the modulation potential $V_M$ to positive potential, the absolute potentials handled by the scanning circuit 301 and the modulation circuit 302 can be reduced and, therefore, the power consumption can be reduced. Similarly, in the configuration in which the high potential electrode of the display element 101 is connected to the row wiring 201, and the low potential electrode of the display element 101 is connected to the column wiring 202, it is desirable that the selection potential $V_S$ be positive potential and the modulation potential $V_M$ be negative potential. However, when the drive circuit 300 is formed as an IC, it is desirable that the modulation potential $V_M$ be positive potential in order to simplify, in particular, the configuration of the modulation circuit 302 having a complicated circuit configuration. Therefore, it is desirable that the low potential electrode of the display element 101 be connected to the row wiring 201 and the high potential electrode of the display element 101 be connected to the column wiring 202.

While the above description has been made with reference to the display element 101 formed from a CL element, the display element 101 is not limited to a CL element, and any light-emitting display apparatus can be used. For example, electroluminescence (EL) elements can be used as the display elements 101 in place of CL elements. EL elements fall into the following types: (intrinsic EL elements, such as organic EL elements or non-organic EL elements, and injection EL elements, such as light-emitting diodes. Like the CL elements shown in FIG. 2C, EL elements have a characteristic in which the emission luminance increases with an increase in the applied voltage. Thus, $V_B<V_W$. By increasing the voltage applied to a display element, the emission luminance can be increased. Alternatively, a display element including a gas discharge element and a phosphor (e.g., a PDP) or a display element including a backlight and a liquid crystal display element (e.g., an LCD) can be used. A liquid crystal display element does not emit light. However, the display element 101 can perform a display operation with a desired emission luminance in proportion to the emission luminance of the backlight and the transmittance of a liquid crystal cell. If the display element has a characteristic in which the emission luminance decreases as the applied voltage increases (e.g., a display element including a normally white liquid crystal display element), $V_W<V_B$. By decreasing the voltage applied to the liquid crystal display element, the emission luminance can be increased. Among a variety of the above-described display elements, a CL element and an EL element can have a significantly low black emission luminance. Thus, the reference illuminance can be decreased. Accordingly, a CL element and an EL element have a desirable characteristic in that the illuminance of the ambient light that provides the advantage of the present invention can be provided in a wide range.

For example, an organic EL element including a pair of electrodes (a cathode and an anode) and an organic light emitting layer disposed between the pair of electrodes and serving as a light emitting member can be used as the display element 101. One of the electrodes is connected to the row wiring 201, and the other is connected to the column wiring 202. In addition, a scanning signal is input to the row wiring 201, and a modulation signal is input to the column wiring 202. Thus, the display element 101 is driven by a difference in potential between the scanning signal and the modulation signal or an electrical current caused by the difference in potential. A method for driving the display element 101 by a difference in potential between the scanning signal and the modulation signal and/or an electrical current caused by the difference in the display panel using the above-described CL element or EL element is referred to as a "passive matrix driving method". In the passive matrix driving method, the emission luminance can be controlled by varying the difference in potential between the row wiring 201 and the column wiring 202, as noted above.

In addition, a configuration using a switching transistor, such as a TFT, can be applied to the display element 101. In such a case, for example, the gate of the transistor is connected to the row wiring 201, and the drain of the transistor is connected to the column wiring 202. In order to drive a display panel including such a display element, a scanning signal is input to the row wirings 201, and the row wirings 201 are sequentially scanned while turning on and off the switching transistor. In addition, a modulation signal having a modulation potential in the range from $V_B$ to $V_W$ is input to the column wiring 202. Such a driving method is referred to as an "active matrix driving method". The capacitance 103 included in the display element 101 can include parasitic capacitance of the switching transistor and a potential holding capacitance connected to the source of the switching transistor. In the active matrix driving method, the display panel 100 includes a common wiring different from the row wiring 201 and the column wiring 202 in addition to the row wiring 201 and the column wiring 202. The display elements 101 are connected to the common wiring. Note that the source and the drain of the transistor can be used in an interchangeable way as needed.

In one form, for example, the above-described switching transistor and a liquid crystal display element including a pair of electrodes and liquid crystal disposed between the pair of electrodes can be used. One of the electrodes of the liquid crystal display element is connected to the source of the switching transistor and the other is connected to a common wiring having a common potential applied thereto. The transmittance of the liquid crystal varies in accordance with the difference in potential between the modulation potential and the common potential.

In another form, for example, a switching transistor, an organic EL element, and a current supply transistor having the source connected to one of two electrodes of the EL element can be used. The source of the switching transistor is connected to the gate of the current supply transistor. Such a form is described in Japanese Patent Laid-Open No. 2002-237390. The other of the two electrodes is connected to a ground wiring. The drain of a current supply transistor is connected to a common wiring having a common potential (a power supply potential). The current supply transistor controls a current flowing in an organic light emitting layer in accordance with a modulation potential. Accordingly, the emission luminance of the organic light emitting layer varies in accordance with the modulation potential and the common potential.

In the case of the active matrix driving method, the emission luminance can be controlled by changing at least one of the modulation potential applied to the column wiring 202 and the common potential applied to the common wiring. Note that when the polarity is reversed as in an LCD, a normally white liquid crystal display element switches the black level potential between $V_B$ and $-V_B$ for every selection period. Thus, the total amplitude of the modulation signal is $|V_B-(-V_B)|(=|2V_B|)$. By decreasing each of $|V_B-V_W|$ and $|V_B-(-V_B)|$ for every selection period, the charging/discharging power of the modulation circuit 302 can be reduced. This is substantially the same as decreasing the total amplitude $|2V_B|$. In the active matrix driving method, the emission luminance remains unchanged even when the selection potential $V_S$ is changed. However, as shown in FIG. 5A, by changing the black level potential $V_B$, $|V_W-V_B|$ can be decreased. In contrast, the white level potential $V_W$ can be changed without changing the black level potential $V_B$. In such a case, the common potential is also changed. According to the present invention, the passive matrix driving method is more desirable than the active matrix driving method, since the examples shown in FIGS. 5B to 5D can be employed in an appropriate manner.

Figure 6A:
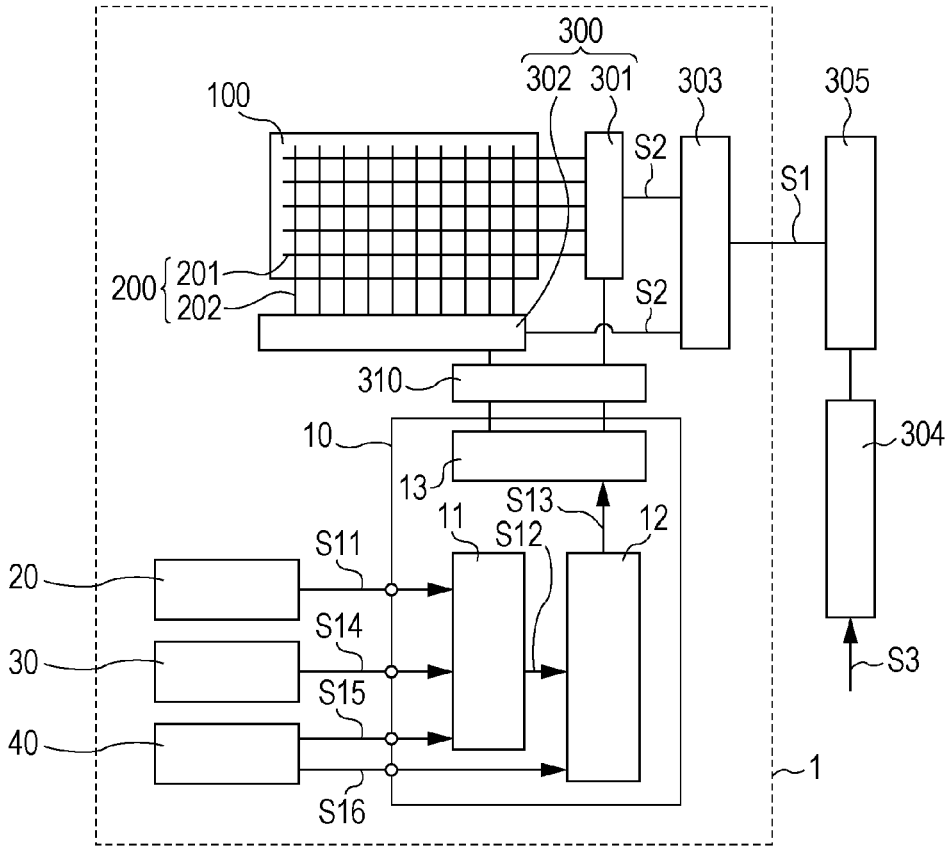
FIGS. 6A to 6C illustrate an example of an information display system.

FIG. 6A is a block diagram of a main portion of a display apparatus that employs the above-described driving method. Since the display panel 100 and the drive circuit 300 are the same as those shown in FIG. 1A, descriptions thereof are not repeated. In FIG. 6A, a power supply 310 for supplying a modulation potential, a selection potential, and a non-selection potential to the drive circuit 300 is shown. A display apparatus 1 includes a controller 10. The controller 10 functions as changing means for changing a drive signal. The controller 10 includes an evaluation unit 11, a determination unit 12, and a control unit 13. The evaluation unit 11 is connected to the determination unit 12. The determination unit 12 is connected to the control unit 13. The control unit 13 is connected to the drive circuit 300 (the scanning circuit 301 and the modulation circuit 302). The display apparatus 1 further includes a conversion circuit 303, which receives a video signal S1 including a luminance signal overlapped with a synchronization signal. The conversion circuit 303 converts the video signal S1 into a display signal S2 including emission luminance data and a timing signal. More specifically, the conversion circuit 303 converts the luminance signal into emission luminance data in a format that complies with the modulation circuit 302 and converts the synchronization signal into a timing signal. The drive circuit 300 converts the input display signal S2 into a scanning signal and a modulation signal in synchronization with the timing signal. Thus, the drive circuit 300 drives the display panel 100. The emission luminance data included in the display signal S2 indicates a gray scale in accordance with the emission luminance for a display operation. The modulation circuit 302 converts the emission luminance data into a modulation signal using a predetermined modulation method and outputs the modulation signal to the column wiring 202. The configurations of the drive circuit 300 and the conversion circuit 303 are described in Japanese Patent Laid-Open No. 2000-56730.

The display apparatus 1 includes an illuminance sensor 20. The illuminance sensor 20 is connected to the controller 10. The illuminance sensor 20 is disposed in the vicinity of the display surface of the display panel 100. Thus, the illuminance sensor 20 can transmit illuminance data S11 in accordance with the illuminance of the ambient light in the vicinity of the display surface of the display panel 100. The evaluation unit 11 receives the illuminance data S11 transmitted from the illuminance sensor 20. The evaluation unit 11 can include a diffuse reflection luminance computing circuit that computes diffuse reflection luminance data S12 by multiplying a predetermined coefficient corresponding to a diffuse reflectivity by the illuminance data S11. Alternatively, the evaluation unit 11 can include s memory that stores a conversion table used for converting the illuminance data S11 into the diffuse reflection luminance data S12. Still alternatively, the illuminance data S11 can be used as the diffuse reflection luminance data S12 without actual conversion. In such a case, the diffuse reflection luminance computing circuit and the conversion table for computing the diffuse reflection luminance are not necessary. In this way, the evaluation unit 11 outputs the obtained diffuse reflection luminance data S12 to the determination unit 12.

The determination unit 12 prestores a determination criterion for determining control data S13 from the diffuse reflection luminance data S12 and outputting the control data S13. The control data S13 can include scanning circuit control data for controlling the selection potential $V_S$ and the non-selection potential $V_N$ and modulation circuit control data for controlling the selection potential $V_S$ and the white level potential $V_W$. The determination criterion includes a correspondence between the emission luminance and the diffuse reflection luminance. The determination criterion can be represented in the form of a table used for determining the diffuse reflection luminance data S12 and converting the diffuse reflection luminance data S12 into the control data S13. The table can be stored in the memory. Alternatively, the determination criterion can be represented in the form of algorithm for computing the control data S13 in accordance with the diffuse reflection luminance data S12. The algorithm can be defined in the computing circuit.

For example, the determination unit 12 determines whether the diffuse reflection luminance indicated by the diffuse reflection luminance data S12 is lower than the reference diffuse reflection luminance, is equal to the reference diffuse reflection luminance, or is higher than the reference diffuse reflection luminance using the determination criterion. Note that the determination need not be made using a condition in which the diffuse reflection luminance is equal to the reference diffuse reflection luminance, but may be made by determining whether the diffuse reflection luminance indicated by the diffuse reflection luminance data S12 is under a certain condition including a condition in which the diffuse reflection luminance data S12 is equal to the reference diffuse reflection luminance. The determination unit 12 determines the control data S13 for each of the detected conditions using the determination criterion and outputs the control data S13 to the control unit 13. For example, if the determination unit 12 detects a condition in which the diffuse reflection luminance indicated by the diffuse reflection luminance data S12 is lower than or equal to the reference diffuse reflection luminance, the determination unit 12 outputs predetermined control data S13. If the determination unit 12 detects a condition in which the diffuse reflection luminance indicated by the diffuse reflection luminance data S12 is higher than the reference diffuse reflection luminance, the determination unit 12 outputs control data S13 that is changed from the above-described predetermined control data S13. The changed control data S13 is used for decreasing $|V_W-V_B|$ to a value smaller than the predetermined control data S13. In addition, the changed control data S13 is set so that the black emission luminance is increased without exceeding the diffuse reflection luminance.

The control unit 13 controls the output of the drive circuit 300 on the basis of the control data S13. More specifically, the control unit 13 controls the selection potential $V_S$ and the non-selection potential $V_N$ output from the scanning circuit 301 on the basis of the scanning circuit control data. In addition, the control unit 13 controls the black level potential $V_B$ and the white level potential $V_W$ output from the modulation circuit 302 on the basis of the modulation circuit control data.

The selection potential $V_S$ and the non-selection potential $V_N$ output from the scanning circuit 301 and the black level potential $V_B$ and the white level potential $V_W$ output from the modulation circuit 302 follow the determination results.

As an example, the control unit 13 controls the power supply 310 that drives the drive circuit 300. The control unit 13 changes the selection potential $V_S$ and/or the non-selection potential $V_N$ output from the power supply 310 to the scanning circuit 301 in accordance with the scanning circuit control data. In addition, the control unit 13 changes the black level potential $V_B$ and/or the white level potential $V_W$ output from the power supply 310 to the modulation circuit 302 in accordance with the modulation circuit control data included in the control data S13. The scanning circuit 301 and the modulation circuit 302 perform modulation using the potential output from the power supply 310 and a predetermined method on the basis of the display signal S2 and scan the row wirings 201. In this way, the scanning circuit 301 and the modulation circuit 302 drive the display panel 100. While the example in which all of the selection potential $V_S$, the non-selection potential $V_N$, the black level potential $V_B$, and the white level potential $V_W$ are output from the power supply has been described, the power supply 310 need not output all of the potentials if one of the potentials is a ground potential.

As another example, the control unit 13 changes a method for scanning the row wirings using the scanning circuit 301 or a method for modulating the display signal S2 using the modulation circuit 302. The method for scanning the row wirings using the scanning circuit 301 and the method for modulating the display signal S2 using the modulation circuit 302 are defined in different conversion tables or different computing circuits of the scanning circuit 301 and the modulation circuit 302. From among the different conversion tables or different computing circuits, the control unit 13 selects a scanning method and a modulation method for driving the display panel 100 on the basis of at least one of the scanning circuit control data and the modulation circuit control data.

For example, the case in which the modulation circuit 302 includes a first conversion table and a second conversion table in order to perform a pulse amplitude modulation in 256 gray scales from 0 to 255 is described next. The first conversion table indicates that when an emission luminance of "0" is input to the modulation circuit 302, a modulation potential of 0 [V] is continuously output during one selection period. In addition, the first conversion table indicates that when an emission luminance of "255" is input to the modulation circuit 302, the modulation circuit 302 outputs potentials of 0 [V], +9 [V], and 0 [V] in this order during one selection period. In contrast, the second conversion table includes a correspondence indicating that when an emission luminance of "0" is input, a modulation potential of 1 [V] is continuously output during one selection period. In addition, the second conversion table includes a correspondence indicating that when an emission luminance of "255" is input to the modulation circuit 302, the modulation circuit 302 outputs potentials of +1 [V], +9 [V], and +1 [V] in this order during one selection period. If the determination unit 12 outputs the control data S13 corresponding to an environment in which the diffuse reflection luminance is lower than or equal to the reference diffuse reflection luminance, the control unit 13 selects the first conversion table of the modulation circuit 302. However, if the determination unit 12 outputs the control data S13 corresponding to an environment in which the diffuse reflection luminance is higher than the reference diffuse reflection luminance, the control unit 13 selects the second conversion table of the modulation circuit 302. By using such a method, a change that is the same as that shown in FIG. 5A is available.

As still another example, the case in which the modulation circuit 302 includes the above-described first conversion table and a third conversion table and the scanning circuit 301 includes a fourth conversion table is described next. The third conversion table includes a correspondence indicating that when an emission luminance of "0" is input, a modulation potential of 0 [V] is continuously output during one selection period. In addition, the third conversion table includes a correspondence indicating that when an emission luminance of "255" is input to the modulation circuit 302, the modulation circuit 302 outputs potentials of +0 [V], +8 [V], and +0 [V] in this order during one selection period. The fourth conversion table includes a correspondence indicating that when the determination unit 12 outputs the control data S13 corresponding to an environment in which the diffuse reflection luminance is lower than or equal to the reference diffuse reflection luminance, the selection potential is set to −9 [V]. Furthermore, the fourth conversion table includes a correspondence indicating that when the determination unit 12 outputs the control data S13 corresponding to an environment in which the diffuse reflection luminance is higher than the reference diffuse reflection luminance, the selection potential is set to −10 [V]. When the determination unit 12 outputs the control data S13 corresponding to the environment in which the diffuse reflection luminance is lower than or equal to the reference diffuse reflection luminance, the control unit 13 selects the first conversion table of the modulation circuit 302. However, when the determination unit 12 outputs the control data S13 corresponding to the environment in which the diffuse reflection luminance is higher than the reference diffuse reflection luminance, the control unit 13 selects the third conversion table of the modulation circuit 302. By using such a method, a change that is the same as that shown in FIG. 5B is available.

An example of the determination criterion is shown in FIG. 4B. In FIG. 4B, the stepped lines B1, B2, B3, and B4 represent the black emission intensities switched by the drive voltage according to the present invention. As indicated by the line B1, the controller 10 performs setting so that $V_{SD}$=−8 [V], $V_{ND}$=0 [V], $V_{BD}$=0 [V], and $V_{WD}$=+10 [V] when the illuminance of the ambient light is lower than 5 [lx]. As indicated by the line B2, the controller 10 performs setting so that $V_{SD}$=−9 [V], $V_{ND}$=0 [V], $V_{BD}$=0 [V], and $V_{WD}$=+9 [V] when the illuminance of the ambient light is higher than or equal to 5 [lx] and lower than 50 [lx]. As indicated by the line B3, the controller 10 performs setting so that $V_{SD}$=−10 [V], $V_{ND}$=0 [V], $V_{BD}$=0 [V], and $V_{WD}$=+8 [V] when the illuminance of the ambient light is higher than or equal to 50 [lx] and lower than 500 [lx]. As indicated by the line B4, the controller 10 performs setting so that $V_{SD}$=−11 [V], $V_{ND}$=0 [V], $V_{BD}$=0 [V], and $V_{WD}$=+7 [V] when the illuminance of the ambient light is higher than or equal to 500 [lx].

When $F_V$=120 {Hz] and $C_D$=0.4 [pF] and if the illuminance of the ambient light is lower than 5 [lx] (B1), the charging/discharging power is 32.4 [W]. If the illuminance of the ambient light is higher than or equal to 5 [lx] and lower than 50 [lx] (B2), the charging/discharging power is 26.2 [W]. If the illuminance of the ambient light is higher than or equal to 50 [lx] and lower than 500 [lx] (B3), the charging/discharging power is 20.7 [W]. If the illuminance of the ambient light is higher than or equal to 500 [lx] (B4), the charging/discharging power is 15.9 [W]. In this way, in the area (3), as the illuminance of the ambient light increases, the power consumption can be decreased. Note that in the area (2), a decrease in display quality that the user experiences is small as compared with that in the area (1). However, in the area (1), the power consumption is not decreased. In a dark room in which the illuminance of the ambient light is lower than 5 [lx] (e.g., an environment in which the user watches a movie), the user is sensitive to even dim light. Accordingly, it is desirable that the black emission luminance be set to be low so that the display quality has a priority over reduction in power.

In FIG. 4B, the black emission luminance is changed in four steps B1 to B4. However, the number of steps may be two. Alternatively, the black emission luminance may be changed continuously, not in a stepwise manner. For example, in the case of using two steps, when the illuminance of the ambient light is lower than 20 [lx], the following setting is used: $V_{SD}$=−8 [V], $V_{ND}$=0 [V], $V_{BD}$=0 [V], and $V_{WD}$=+10 [V]. When the illuminance of the ambient light is higher than or equal to 20 [lx], the following setting is used: $V_{SD}$=−9.5 [V], $V_{ND}$=0 [V], $V_{BD}$=0 [V], and $V_{WD}$=+8.5 [V]. When $F_V$=120 [Hz] and $C_D$=0.4 [pF] and if the illuminance of the ambient light is lower than 20 [lx], the charging/discharging power is 32.4 [W]. If the illuminance of the ambient light is higher than or equal to 20 [lx], the charging/discharging power is 23.4 [W]. Accordingly, the charging/discharging power can be reduced by 9 [W]. In a normal living environment, the illuminance of the ambient light is higher than several tens [lx]. Accordingly, even two-step change is employed, a sufficient advantage can be provided.

Figure 7A:
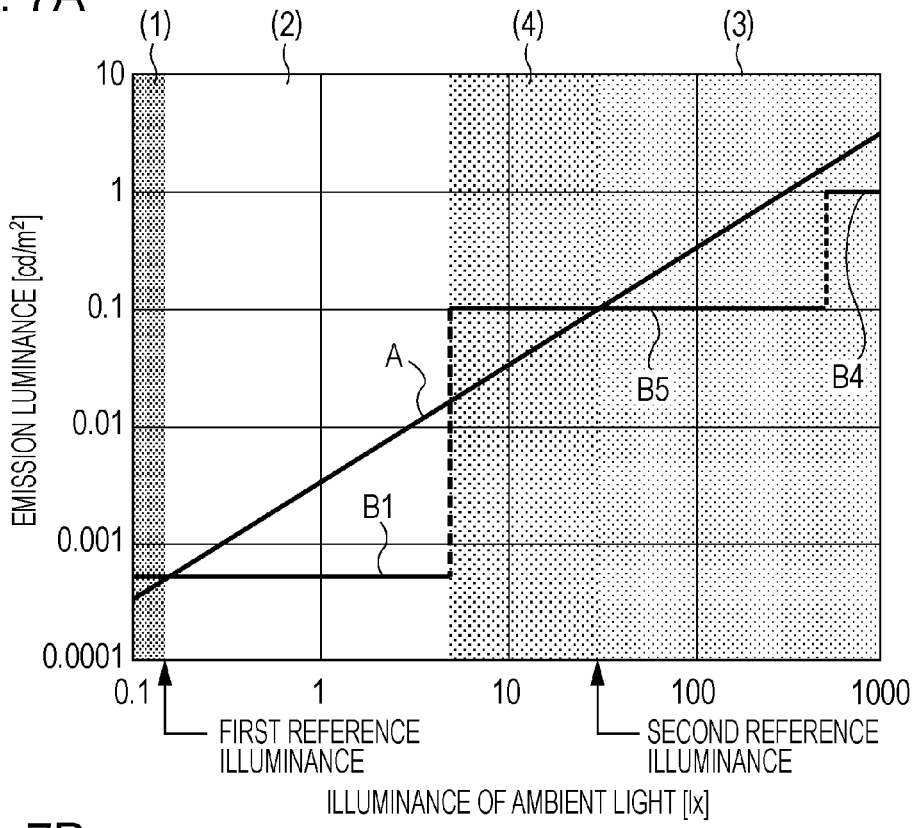
FIGS. 7A and 7B illustrate an example of a method for driving a display panel.

Another example of the determination criterion is shown in FIG. 7A. In FIG. 7A, the examples indicated by the lines B1 and B4 are the same as those in FIG. 4B. As indicated by the line B5, when the illuminance of the ambient light is higher than or equal to 5 [lx] and lower than 500 [lx], the black emission luminance is set to 0.1 [cd/m$^2$]. In this case, the reference illumination intensities are 0.16 [lx] (a first reference illuminance) and 30 [lx] (a second reference illuminance). In the area (4) in which the illuminance of the ambient light is higher than or equal to 5 [lx] and lower than 30 [lx], the black emission luminance is higher than the diffuse reflection luminance. Therefore, the area (4) indicates an effective dark environment. Accordingly, the display quality that the user perceives is significantly decreased, as compared with those in the areas (1) and (2). However, the environment in which the illuminance of the ambient light is higher than or equal to 5 [lx] and lower than 30 [lx] is darker than the normal living environment and is brighter than, for example, the environment in which the user watches a movie. In such an environment, the user may not be present or an excellent display quality may not be required. In such a case, as indicated by the area (4), the black emission luminance can be increased to even a value that exceeds the diffuse reflection luminance in order to reduce the power consumption.

Figure 7B:
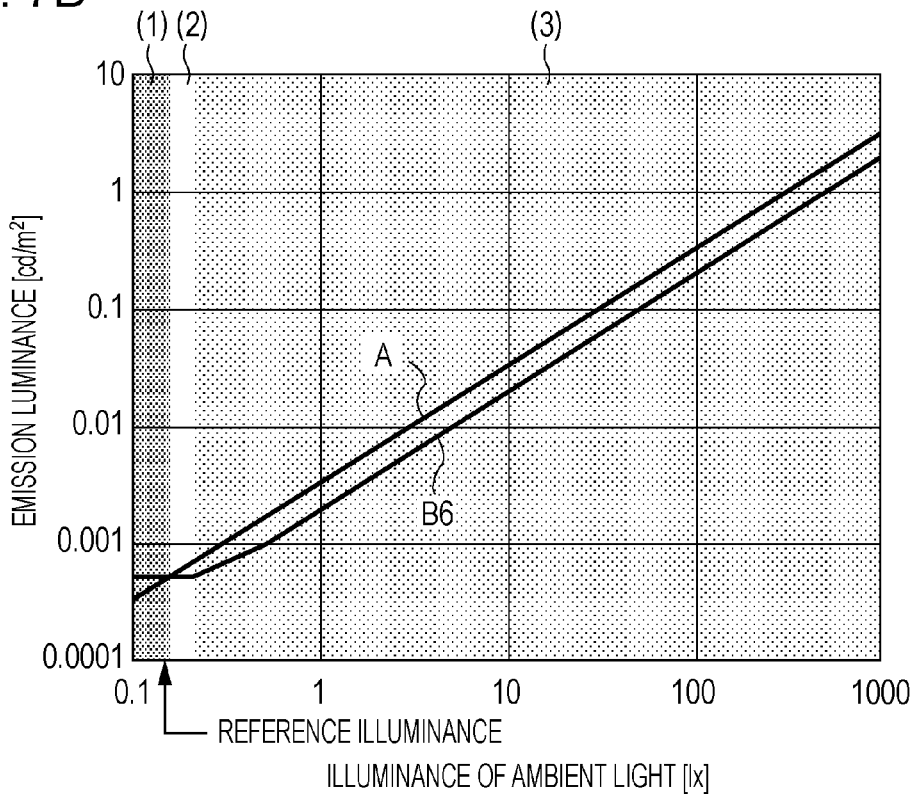

FIG. 7B illustrates the black emission luminance and the diffuse reflection luminance obtained when the drive signal is continuously changed in accordance with the illuminance of the ambient light. A curved line B6 indicates the black emission luminance changed in accordance with the illuminance of the ambient light. As indicated by the curved line B6, if the drive signal is changed so that the black emission luminance is continuously reduced, a decrease in the display quality can be prevented while reducing the power consumption in high accuracy for a variety of illumination intensities of the ambient light. Such a continuous change can be realized by the controller 10 determining the potentials of the scanning signal and the modulation signal using a computing circuit including a defined function of illuminance of ambient light.

Figure 6B:
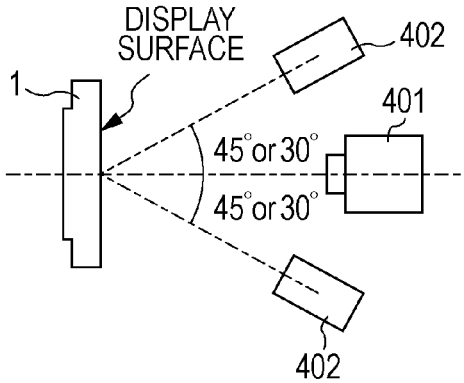

It is desirable that the method illustrated in FIG. 6B be used as a method for measuring the diffuse reflection luminance required for determining the determination criterion. In FIG. 6B, the display surface of the display panel 100 of the display apparatus 1 is disposed so as to face a D65 light source 402 having a directivity of 15°. More specifically, the D65 light source 402 is disposed so as to have an optical axis at an angle of 30° or 45° with respect to the vertical direction of the display panel 100 of the display apparatus 1. A luminance meter 401 is disposed so as to be perpendicular to the display panel 100 of the display apparatus 1. By measuring the diffuse reflection luminance using the luminance meter 401 with no display on the display surface, the diffuse reflection luminance of the display panel 100 can be obtained. Note that this method for measuring the diffuse reflection luminance is described in ISO13406-2. At that time, an illuminance sensor is set in the vicinity of the display surface of the display panel 100, and the illuminance of the ambient light is measured. Thus, a relationship between the illuminance of the ambient light and the diffuse reflection luminance (i.e., a diffuse reflectivity) can be obtained.

Figure 6C:
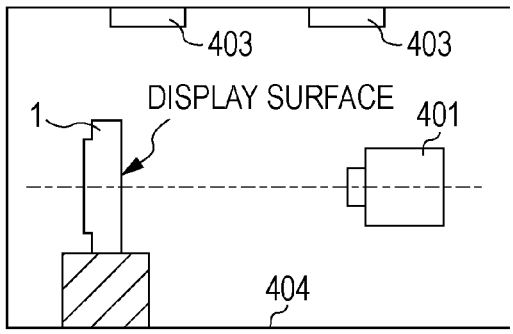

Alternatively, in order to measure the diffuse reflection luminance, an actual use environment may be taken into account, and the configuration shown in FIG. 6C can be used. In FIG. 6C, the luminance meter 401 is disposed so as to be perpendicular to the display panel 100 of the display apparatus 1. The diffuse reflection luminance is obtained by determining the illuminance of the ambient light in accordance with the environment in which the user looks at the display apparatus 1 and measuring the emission luminance of the display panel 100 under the ambient light using the luminance meter 401. According to this method, the diffuse reflection luminance induced by the following types of light can be measured: light emitted from the lighting device 403 and entering the display panel 100, light emitted from the lighting device 403, reflected off a floor 404, and entering the display panel of the display apparatus 1, and light emitted from the lighting device 403, reflected off a wall (not shown), and entering the display panel of the display apparatus 1. This measurement method allows an effect of the diffuse reflection to be measured under a condition close to an actual use environment.

In the above-described examples, the drive voltage is controlled on the basis of the illuminance data S11 input to the evaluation unit 11. However, the information input to the evaluation unit 11 is not limited to the illuminance data S11.

For example, in FIG. 6A, the display apparatus 1 includes a timer 30. The timer 30 is connected to the controller 10. The timer 30 counts up the time and outputs clock time data S14 to the evaluation unit 11. The evaluation unit 11 compares the received clock time data S14 with preset clock information. The evaluation unit 11 evaluates that the illuminance of the ambient light is 400 [lx] from 6 a.m. to 6 p.m. (during daytime). The evaluation unit 11 further evaluates that the illuminance of the ambient light is 100 [lx] from 6 p.m. to 6 a.m. (during nighttime). The evaluation unit 11 outputs, to the determination unit 12, diffuse reflection luminance data S12 that corresponds to the evaluated illuminance of the ambient light. The timer 30 may maintain a date in addition to a clock time. The times of sunrise and sunset changes from day to day. Accordingly, the evaluation unit 11 may change the evaluated illuminance of the ambient light in accordance with the date and time.

As shown in FIG. 6A, the display apparatus 1 includes an instruction input unit 40. The instruction input unit 40 is connected to the controller 10. When the user selects one of environment brightness buttons of the instruction input unit 40, the instruction input unit 40 sends, to the controller 10, environment brightness data S15 as input data. Upon receiving the environment brightness data S15, the controller 10 performs the following operation in accordance with the environment brightness data S15. If the environment brightness data S15 sent from the instruction input unit 40 indicates a "bright room", the evaluation unit 11 evaluates that the illuminance of the ambient light is 300 [lx]. However, if the environment brightness data S15 indicates a "dark room", the evaluation unit 11 evaluates that the illuminance of the ambient light is 30 [lx]. Note that the configuration of the instruction input unit 40 can be appropriately designed. The instruction input unit 40 may be disposed on the housing that includes the display panel 100. Alternatively, the instruction input unit 40 may be disposed on a set-top box different from the housing or on a remote controller. In addition, the form of the instruction input unit 40 is not limited to buttons. For example, a GUI may be displayed on the display panel 100, and the user may input an instruction through, for example, a remote controller while viewing the GUI.

The evaluation unit 11 may evaluate the illuminance of the ambient light using the clock time data S14 received from the timer 30 and the environment brightness data S15 received from the instruction input unit 40. The human perception depends on not only the brightness in a room but also the brightness outside the room. Therefore, evaluation of the illuminance of the ambient light is changed in accordance with whether it is a bright time or a dark time even when "bright room" is selected using the instruction input unit 40. When the clock time data S14 indicates a time between 6 a.m. to 6 p.m. (a daytime) and if the environment brightness data S15 indicating "bright room" is input, the evaluation unit 11 evaluates that the illuminance of the ambient light is 500 [lx]. When the clock time data S14 indicates a time between 6 p.m. to 6 a.m. (a nighttime) and if the environment brightness data S15 indicating "bright room" is input, the evaluation unit 11 evaluates that the illuminance of the ambient light is 200 [lx]. When the clock time data S14 indicates a time between 6 a.m. to 6 p.m. (a daytime) and if the environment brightness data S15 indicating "dark room" is input, the evaluation unit 11 evaluates that the illuminance of the ambient light is 50 [lx]. When the clock time data S14 indicates a time between 6 p.m. to 6 a.m. (a nighttime) and if the environment brightness data S15 indicating "dark room" is input, the evaluation unit 11 evaluates that the illuminance of the ambient light is 20 [lx]. Similarly, the illuminance of the ambient light may be evaluated using the illuminance data S11 received from the illuminance sensor 20 and the clock time data S14.

In the configuration shown in FIG. 6A, the display apparatus 1 does not need all of the illuminance sensor 20, the timer 30, and the instruction input unit 40. When the illuminance sensor 20 is used, the evaluation accuracy of the diffuse reflection luminance is increased. However, if the intensity of light incident on the illuminance sensor 20 significantly differs from the illuminance of the ambient light incident on the display surface of the display panel 100, display that the user does not desire may be performed. At that time, by changing the drive signal in accordance with an instruction from the user through the instruction input unit 40, an optimal display quality with which the user does not feel dissatisfied can be provided.

In addition, a mode can be switched between a power saving mode and a high image quality mode. In the power saving mode, a change in a drive signal in accordance with the illuminance of the ambient light is enabled. In contrast, in the high image quality mode, the change in a drive signal is disabled. When one of a power saving mode button and a high image quality mode button of the instruction input unit 40 is pressed by the user, the instruction input unit 40 sends, to the determination unit 12, mode data S16 indicating one of power saving mode data and high image quality mode data. When the determination unit 12 receives the mode data S16 and if the determination unit 12 determines that the mode data S16 is power saving mode data, the determination unit 12 enables a change in the drive signal in accordance with the illuminance of the ambient light. However, if the determination unit 12 determines that the mode data S16 is high image quality mode data, the determination unit 12 disables a change in the drive signal in accordance with the illuminance of the ambient light.

In addition, a mode may be switched between a power saving mode and a high image quality mode in accordance with the clock time data S14 maintained in the timer 30. For example, in a daytime in which the illuminance of the ambient light is high, the determination unit 12 determines that a power saving mode is selected and enables a change in the drive signal in accordance with the illuminance of the ambient light. However, in a nighttime in which the illuminance of the ambient light is low, the determination unit 12 determines that a high image quality mode is selected and disables a change in the drive signal in accordance with the illuminance of the ambient light.

It is desirable that at least two types of power saving mode set by the instruction input unit 40 be provided so that the user can select the level of increasing the black emission luminance. Since there is a trade-off between reduction in power consumption and prevention of a decrease in the image quality, it is desirable that the user be able to select the level of increasing the black emission luminance.

The above-described configuration of the controller 10 is only an example. Numerous and various modifications can be made without departing from the spirit of the present invention. While the foregoing embodiment has been described with reference to the configuration in which the control unit 13 controls the power supply 310 and the drive circuit 300, a configuration in which the control unit 13 controls the conversion circuit 303 so that a drive signal is changed can be employed.

The display apparatus according to the present invention can be suitably used for an information display system. The information display system includes the display apparatus 1. At least one of image information and text information is displayed on the display panel 100 of the display apparatus 1. The information display system further includes a receiving circuit 304 for receiving an information signal S3 including at least one of image information and text information. The information signal S3 can be received from a recording apparatus (not shown) or an image pickup apparatus (not shown) through broadcasting or data communication. An example of the information signal S3 is a television signal. The receiving circuit 304 includes a tuner and a decoder as needed. The information signal S3 received by the receiving circuit 304 is converted into the video signal S1 by a signal processing circuit 305 included in the information display system. Alternatively, a configuration in which a drive signal is changed by the control unit 13 controlling the signal processing circuit 305 is employed for the information display system.

Furthermore, the present invention can be realized by performing the following processing. That is, the software (a program) that realizes the functions of the above-described embodiment is supplied to a computer (not shown) included in the information display system via communication means or a variety of storage media. The computer (e.g., a CPU or an MPU) reads and executes the program. In such a case, the code of the program read from the storage media realizes the functions of the above-described embodiment. In addition, the storage media that store the program code realize the present invention. For example, the computer functions as changing means by reading and executing the above-described program.

According to the present invention, power consumption can be reduced without a decrease in image quality that a user experiences.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Application No. PCT/JP2009/069984, filed Nov. 26, 2009, which is hereby incorporated by reference herein in its entirety.

What is claimed is:

1. A method for driving a display panel, the display panel comprising a plurality of row wirings, a plurality of column wirings that intersect the plurality of row wirings, and a plurality of display elements each connected to one of the row wirings and one of the column wirings, a display operation being performed on a display surface of the display panel by sequentially applying a selection potential to each of the row wirings and applying, to each of the column wirings, a potential in the range from a first potential to a second potential in synchronization with the application of the selection potential to the row wiring, the display operation being performed within a range of an emission luminance of the display element which is connected to one of the row wirings having the applied selection potential, the range of the emission luminance being higher than or equal to an emission luminance obtained when the first potential is applied to one of the column wirings connected to the display element and lower than or equal to an emission luminance obtained when the second potential is applied to the column wiring connected to the display element, the method comprising the step of:

making a change between (i) a first environment in which a diffuse reflection luminance occurring on the display surface when ambient light is incident on the display surface is equal to the emission luminance of the display element connected to the row wiring having the applied selection potential and the column wiring having the applied first potential and (ii) a second environment in which the diffuse reflection luminance is higher than the diffuse reflection luminance in the first environment, wherein the change is such that (a) a difference between the first potential and the second potential in the second environment is smaller than a difference between the first potential and the second potential in the first environment, and (b) the emission luminance of the display element connected to the row wiring having the applied selection potential and the column wiring having the applied first potential in the second environment is lower than or equal to the diffuse reflection luminance in the second environment and higher than the emission luminance of the display element connected to the row wiring having the applied selection potential and the column wiring having the applied first potential in the first environment.

2. The method according to claim 1, wherein the change involves making an emission luminance of the display element connected to the row wiring having the applied selection potential and the column wiring having the applied second potential in the second environment higher than or equal to an emission luminance of the display element connected to the row wiring having the applied selection potential and the column wiring having the applied second potential in the first environment.

3. The method according to claim 1, wherein the display element connected to the row wiring having the applied selection potential performs the display operation on the display surface of the display panel with an emission luminance in accordance with the selection potential, and wherein the change involves changing the second potential and the selection potential.

4. The method according to claim 1, wherein the change is made based on at least one of the illuminance of ambient light, a clock time, and an instruction received from a user.

5. The method according to claim 1, wherein each of the plurality of display elements includes one of a cathodoluminescence element and an electroluminescence element.

6. A display apparatus comprising:

a display panel including a plurality of row wirings, a plurality of column wirings that intersect the plurality of row wirings, a plurality of display elements each connected to one of the row wirings and one of the column wirings;

a scanning circuit configured to sequentially applying a selection potential to the row wirings;

a modulation circuit configured to apply, to each of the column wirings, a potential in the range from a first potential to a second potential in synchronization with the application of the selection potential to each of the row wirings; and a controller for changing at least one of the first potential and the second potential, wherein an emission luminance of the display element connected to one of the row wirings having the applied selection potential is higher than or equal to an emission luminance obtained when the first potential is applied to each of the column wirings connected to the display element and lower than or equal to an emission luminance obtained when the second potential is applied to the column wiring connected to the display element, and wherein the controller makes the change between (i) a first mode in which a diffuse reflection luminance occurring on a display surface of the display panel when ambient light is incident on the display surface is equal to an emission luminance of the display element connected to the row wiring having the applied selection potential and the column wiring having the applied first potential and (ii) a second mode in which the diffuse reflection luminance is higher than the diffuse reflection luminance in the first mode, and wherein the controller makes the change such that (a) a difference between the first potential and the second potential applied to the column wirings by the modulation circuit in the second mode is smaller than a difference between the first potential and the second potential applied to the column wirings by the modulation circuit in the first mode, and (b) the emission luminance of the display element connected to the row wiring having the applied selection potential and the column wiring having the applied first potential in the second mode is lower than or equal to the diffuse reflection luminance in the second mode and higher than the emission luminance of the display element connected to the row wiring having the applied selection potential and the column wiring having the applied first potential in the first mode.

7. The display apparatus according to claim 6, wherein the controller distinguishes the first mode and the second mode and makes the change based on a result of the distinguishing, and wherein the controller makes the change so that the difference between the first potential and the second potential applied to the column wirings by the modulation circuit in a case where the second mode is distinguished becomes smaller than the difference between the first potential and the second potential applied to the column wirings by the modulation circuit in a case where the first mode is distinguished, and the emission luminance of the display element connected to the row wiring having the applied selection potential and the column wiring having the applied first potential in the case where the second mode is distinguished becomes lower than or equal to the diffuse reflection luminance in the case where the second mode is distinguished and higher than the emission luminance of the display element connected to the row wiring having the applied selection potential and the column wiring having the applied first potential in the case where the first mode occurs is distinguished.

8. The display apparatus according to claim 6, wherein the controller sets the emission luminance of the display element connected to the row wiring having the applied selection potential and the column wiring having the applied second potential in the second mode to a value higher than or equal to the emission luminance of the display element connected to the row wiring having the applied selection potential and the column wiring having the applied second potential in the first mode.

9. The display apparatus according to claim 6, wherein the scanning circuit applies a non-selection potential to the row wirings to which the selection potential are not applied among the plurality of row wirings, wherein, when the modulation circuit applies, to the column wirings, a potential that is in the range from the first potential to the second potential and that is different from the first potential in synchronization with the application of the selection potential to the row wiring, the modulation circuit applies the first potential to the column wiring every time the selection potential is applied to one of the row wirings, and wherein the number of the row wirings is greater than the square of a value obtained by dividing a difference between the selection potential and the non-selection potential by a difference between the first potential and the second potential in the first and second modes.

10. The display apparatus according to claim 6, wherein the display element connected to the row wiring having the applied selection potential has an emission luminance in accordance with the selection potential, and wherein the controller changes the second potential and the selection potential.

11. The display apparatus according to claim 6, further comprising:

at least one of an illuminance sensor configured to output illuminance data obtained in accordance with the illuminance of the ambient light and a timer configured to output clock time data obtained in accordance with a clock time, wherein the controller makes the change between the first mode and the second mode based on at least one of the illuminance data and the clock time data.

12. The display apparatus according to claim 6, wherein each of the plurality of display elements includes one of a cathodoluminescence element and an electroluminescence element.

* * * * *